US011155907B2

(12) United States Patent
Hofmann et al.

(10) Patent No.: US 11,155,907 B2
(45) Date of Patent: Oct. 26, 2021

(54) SYSTEMS AND METHODS FOR SHAPING SHEET MATERIALS THAT INCLUDE METALLIC GLASS-BASED MATERIALS

(71) Applicant: California Institute of Technology, Pasadena, CA (US)

(72) Inventors: Douglas C. Hofmann, Altadena, CA (US); Scott N. Roberts, Altadena, CA (US)

(73) Assignee: California Institute of Technology, Pasadena, CA (US)

( * ) Notice: Subject to any disclaimer, the term of this patent is extended or adjusted under 35 U.S.C. 154(b) by 134 days.

(21) Appl. No.: 15/856,543

(22) Filed: Dec. 28, 2017

(65) Prior Publication Data

US 2018/0119259 A1 May 3, 2018

Related U.S. Application Data

(62) Division of application No. 14/252,585, filed on Apr. 14, 2014, now abandoned.

(Continued)

(51) Int. Cl.
*C22C 45/10* (2006.01)

(52) U.S. Cl.
CPC ..... *C22C 45/10* (2013.01); *Y10T 428/12479* (2015.01)

(58) Field of Classification Search
CPC .... B21D 22/02; B21D 22/022; B21D 22/208; B21D 26/021; B21D 37/16; B21D 17/02;

(Continued)

(56) References Cited

U.S. PATENT DOCUMENTS 3,435,512 A 4/1969 Macrobbie
3,519,444 A 7/1970 Brown et al.

(Continued)

FOREIGN PATENT DOCUMENTS

CN 101709773 A 5/2010
CN 102563006 A 7/2012

(Continued)

OTHER PUBLICATIONS

Sanders et al., "Stability of Al-rich glasses in the Al—La—Ni system", 2006, Intermetallics, 14, pp. 348-351.

(Continued)

*Primary Examiner* — Edward T Tolan
(74) *Attorney, Agent, or Firm* — KPPB LLP

(57) ABSTRACT

Systems and methods in accordance with embodiments of the invention advantageously shape sheet materials that include metallic glass-based materials. In one embodiment, a method of shaping a sheet of material including a metallic glass-based material includes: heating a metallic glass-based material within a first region within a sheet of material to a temperature greater than the glass transition temperature of the metallic glass-based material; where the sheet of material has a thickness of between 0.1 mm and 10 mm; where at least some portion of the sheet of material does not include metallic glass-based material that is heated above its respective glass transition temperature when the metallic glass-based material within the first region is heated above its respective glass transition temperature; and deforming the metallic glass-based material within the first region while the temperature of the metallic glass-based material within the first region is greater than its respective glass transition temperature.

17 Claims, 20 Drawing Sheets

Related U.S. Application Data

(60) Provisional application No. 61/811,405, filed on Apr. 12, 2013.

(58) Field of Classification Search
CPC ..... C22F 1/183; C22F 1/186; C22C 1/002; C22C 33/003; C22C 45/00; C22C 45/10; Y10T 428/12479
See application file for complete search history.

(56) References Cited

U.S. PATENT DOCUMENTS 3,529,457 A 9/1970 Bowers
3,682,606 A 8/1972 Anderson et al.
3,986,412 A 10/1976 Farley et al.
4,123,737 A 10/1978 Hoagland, Jr.
RE29,989 E 5/1979 Polk
4,173,393 A 11/1979 Maurer
4,202,404 A 5/1980 Carlson
4,584,036 A * 4/1986 Taub ..... H01F 1/15358 148/120
4,670,636 A * 6/1987 Taub ..... B23K 26/40 219/121.18
4,711,795 A 12/1987 Takeuchi et al.
4,749,625 A 6/1988 Obayashi et al.
4,783,983 A * 11/1988 Narasimhan ..... B22D 11/126 225/93.5
4,810,314 A 3/1989 Henderson et al.
4,812,150 A 3/1989 Scott
4,823,638 A 4/1989 Ishikawa
4,851,296 A 7/1989 Tenhover et al.
4,883,632 A 11/1989 Goto et al.
4,935,291 A 6/1990 Gunnink
5,005,456 A * 4/1991 Ballard ..... B26D 7/10 83/170
5,168,918 A 12/1992 Okuda et al.
5,185,198 A 2/1993 Lefeber et al.
5,288,344 A 2/1994 Peker et al.
5,310,432 A 5/1994 Yamanaka et al.
5,417,385 A 5/1995 Arnold et al.
5,509,978 A 4/1996 Masumoto et al.
5,636,550 A 6/1997 Deane
5,746,844 A 5/1998 Sterett et al.
5,772,803 A 6/1998 Peker et al.
5,866,272 A 2/1999 Westre et al.
5,896,642 A 4/1999 Peker et al.
5,985,204 A 11/1999 Otsuka et al.
6,162,130 A 12/2000 Masumoto et al.
6,273,322 B1 8/2001 Yamamoto et al.
6,620,264 B2 9/2003 Kundig et al.
6,652,679 B1 11/2003 Inoue et al.
6,732,606 B1 5/2004 Zhu et al.
6,771,490 B2 8/2004 Peker et al.
6,843,496 B2 1/2005 Peker et al.
6,887,586 B2 5/2005 Peker et al.
7,052,561 B2 5/2006 Lu et al.
7,073,560 B2 7/2006 Kang et al.
7,075,209 B2 7/2006 Howell et al.
7,323,071 B1 1/2008 Branagan
7,357,731 B2 4/2008 Johnson et al.
7,360,419 B2 4/2008 French et al.
7,497,981 B2 3/2009 Graham et al.
7,500,987 B2 3/2009 Bassler et al.
7,540,929 B2 6/2009 Demetriou et al.
7,552,664 B2 6/2009 Bulatowicz
7,575,040 B2 * 8/2009 Johnson ..... B22D 11/001 164/423
7,862,323 B2 1/2011 Micarelli et al.
7,883,592 B2 2/2011 Hofmann et al.
7,896,982 B2 3/2011 Johnson et al.
7,955,713 B2 6/2011 Roebroeks et al.
8,042,770 B2 10/2011 Martin et al.
8,400,721 B2 3/2013 Bertele et al.
8,418,366 B2 4/2013 Wang et al.
8,485,245 B1 7/2013 Prest et al.
8,496,077 B2 7/2013 Nesnas et al.
8,596,106 B2 12/2013 Tang et al.
8,613,815 B2 12/2013 Johnson et al.
8,639,484 B2 1/2014 Wei et al.
8,789,629 B2 7/2014 Parness et al.
8,986,469 B2 3/2015 Khalifa et al.
9,044,805 B2 6/2015 Prest et al.
9,057,120 B2 6/2015 Pham et al.
9,211,564 B2 12/2015 Hofmann
9,328,813 B2 5/2016 Hofmann et al.
9,579,718 B2 2/2017 Hofmann
9,610,650 B2 4/2017 Hofmann et al.
9,689,231 B2 6/2017 Fripp et al.
9,783,877 B2 10/2017 Hofmann et al.
9,791,032 B2 10/2017 Hofmann et al.
9,868,150 B2 1/2018 Hofmann et al.
9,996,053 B2 * 6/2018 O'Keeffe ..... C22C 45/10
10,081,136 B2 9/2018 Hofmann et al.
10,151,377 B2 12/2018 Hofmann et al.
10,155,412 B2 12/2018 Parness et al.
10,174,780 B2 1/2019 Hofmann et al.
10,471,652 B2 11/2019 Hofmann et al.
10,487,934 B2 11/2019 Kennett et al.
10,690,227 B2 6/2020 Hofmann et al.
10,883,528 B2 1/2021 Hofmann et al.
10,941,847 B2 3/2021 Hofmann et al.
10,953,688 B2 3/2021 Parness et al.
10,968,527 B2 4/2021 Hofmann et al.
11,014,162 B2 5/2021 Hofmann
2002/0053375 A1 5/2002 Hays et al.
2002/0100573 A1 8/2002 Inoue et al.
2002/0184766 A1 12/2002 Kobayashi et al.
2003/0052105 A1 3/2003 Nagano et al.
2003/0062811 A1 4/2003 Peker et al.
2004/0035502 A1 2/2004 Kang et al.
2004/0103536 A1 6/2004 Kobayashi et al.
2004/0103537 A1 6/2004 Kobayashi et al.
2004/0154701 A1 8/2004 Lu et al.
2005/0034792 A1 2/2005 Lu et al.
2005/0084407 A1 4/2005 Myrick
2005/0127139 A1 6/2005 Slattery et al.
2005/0263932 A1 12/2005 Heugel
2006/0105011 A1 5/2006 Sun et al.
2006/0130944 A1 6/2006 Poon et al.
2006/0156785 A1 7/2006 Mankame et al.
2007/0034304 A1 2/2007 Inoue et al.
2007/0039689 A1 2/2007 Petersson et al.
2007/0144621 A1 6/2007 Farmer et al.
2007/0226979 A1 10/2007 Paton et al.
2007/0228592 A1 10/2007 Dunn et al.
2007/0253856 A1 11/2007 Vecchio et al.
2007/0270942 A1 11/2007 Thomas
2008/0085368 A1 4/2008 Gauthier et al.
2008/0099175 A1 * 5/2008 Chu ..... B22D 17/2245 164/66.1
2008/0121316 A1 5/2008 Duan et al.
2008/0190521 A1 8/2008 Loffler et al.
2008/0304975 A1 12/2008 Clark et al.
2009/0011846 A1 1/2009 Scott
2009/0078370 A1 * 3/2009 Sklyarevich ..... C03B 33/09 156/712
2009/0114317 A1 5/2009 Collier et al.
2009/0194205 A1 8/2009 Loffler et al.
2009/0246398 A1 10/2009 Kurahashi et al.
2009/0263582 A1 10/2009 Batchelder
2009/0277540 A1 11/2009 Langlet
2009/0288741 A1 11/2009 Zhang et al.
2010/0313704 A1 12/2010 Wang et al.
2011/0048587 A1 3/2011 Vecchio et al.
2011/0154928 A1 6/2011 Ishikawa
2011/0302783 A1 12/2011 Nagata et al.
2012/0006085 A1 1/2012 Johnson et al.
2012/0067100 A1 3/2012 Stefansson et al.
2012/0073710 A1 3/2012 Kim et al.
2012/0077052 A1 3/2012 Demetriou et al.
2012/0132631 A1 5/2012 Wescott et al.
2012/0133080 A1 5/2012 Moussa et al.
2012/0289946 A1 11/2012 Steger
2013/0009338 A1 1/2013 Mayer

(56) References Cited

U.S. PATENT DOCUMENTS

2013/0048152 A1 2/2013 Na et al.
2013/0062134 A1 3/2013 Parness et al.
2013/0068527 A1 3/2013 Parness et al.
2013/0112321 A1 5/2013 Poole et al.
2013/0133787 A1 5/2013 Kim et al.
2013/0139964 A1 6/2013 Hofmann et al.
2013/0143060 A1 6/2013 Jacobsen et al.
2013/0255837 A1 10/2013 Peker et al.
2013/0277891 A1 10/2013 Teulet
2013/0280547 A1 10/2013 Brandl et al.
2013/0309121 A1 11/2013 Prest et al.
2013/0333814 A1 12/2013 Fleury et al.
2014/0004352 A1 1/2014 McCrea et al.
2014/0010968 A1 1/2014 Prest et al.
2014/0020794 A1 1/2014 Hofmann et al.
2014/0030948 A1 1/2014 Kim et al.
2014/0045680 A1 2/2014 Nakayama et al.
2014/0048969 A1 2/2014 Swanson et al.
2014/0070445 A1 3/2014 Mayer
2014/0083640 A1 3/2014 Waniuk et al.
2014/0090752 A1 4/2014 Waniuk et al.
2014/0093674 A1 4/2014 Hofmann et al.
2014/0141164 A1 5/2014 Hofmann et al.
2014/0163717 A1 6/2014 Das et al.
2014/0202595 A1 7/2014 Hofmann
2014/0203622 A1 7/2014 Yamamoto et al.
2014/0213384 A1 7/2014 Johnson et al.
2014/0224050 A1 8/2014 Hofmann et al.
2014/0227125 A1 8/2014 Hofmann et al.
2014/0246809 A1 9/2014 Hofmann
2014/0293384 A1 10/2014 O'keeffe et al.
2014/0312098 A1 10/2014 Hofmann et al.
2014/0332120 A1 11/2014 Liu et al.
2014/0334106 A1 11/2014 Prest et al.
2014/0342179 A1 11/2014 Hofmann et al.
2014/0348571 A1 11/2014 Prest et al.
2015/0014885 A1 1/2015 Hofmann et al.
2015/0044084 A1 2/2015 Hofmann et al.
2015/0047463 A1 2/2015 Hofmann et al.
2015/0068648 A1 3/2015 Schroers et al.
2015/0075744 A1 3/2015 Hofmann et al.
2015/0158067 A1* 6/2015 Kumar ..... B29C 37/0053 72/202
2015/0165693 A1 6/2015 Sagoo et al.
2015/0183169 A1 7/2015 Ehsani
2015/0209094 A1 7/2015 Anderson
2015/0209889 A1 7/2015 Peters et al.
2015/0219572 A1 8/2015 Beuth, Jr. et al.
2015/0284035 A1 10/2015 Reese
2015/0289605 A1 10/2015 Prest et al.
2015/0298443 A1 10/2015 Hundley et al.
2015/0299825 A1 10/2015 Poole et al.
2015/0314566 A1 11/2015 Mattlin et al.
2015/0323053 A1 11/2015 El-Wardany et al.
2015/0352794 A1 12/2015 Nguyen et al.
2016/0023438 A1 1/2016 Johnson et al.
2016/0175929 A1 6/2016 Colin et al.
2016/0178047 A1 6/2016 Kennett et al.
2016/0186850 A1 6/2016 Hofmann et al.
2016/0233089 A1 8/2016 Zenou et al.
2016/0242877 A1 8/2016 Bernhard
2016/0258522 A1 9/2016 Hofmann et al.
2016/0263937 A1 9/2016 Parness et al.
2016/0265576 A1 9/2016 Hofmann et al.
2016/0299183 A1 11/2016 Lee
2016/0361765 A1 12/2016 Danger et al.
2016/0361897 A1 12/2016 Hofmann et al.
2017/0021417 A1 1/2017 Martin et al.
2017/0050241 A1 2/2017 Thomas et al.
2017/0121799 A1 5/2017 Hofmann et al.
2017/0137955 A1 5/2017 Hofmann et al.
2017/0144225 A1 5/2017 Hofmann
2017/0211168 A1 7/2017 Liu et al.
2017/0226619 A1 8/2017 Hofmann et al.
2018/0257141 A1 9/2018 Hofmann et al.
2018/0272432 A1 9/2018 Jonsson et al.
2018/0339338 A1 11/2018 Hofmann et al.
2018/0339342 A1 11/2018 Hofmann
2018/0345366 A1 12/2018 Hofmann
2019/0009464 A1 1/2019 Steege
2019/0022923 A1 1/2019 Hofmann et al.
2019/0037721 A1 1/2019 Curran et al.
2019/0126674 A1 5/2019 Parness et al.
2019/0154130 A1 5/2019 Hofmann et al.
2019/0177826 A1 6/2019 Hofmann et al.
2019/0255635 A1 8/2019 HÄnni et al.
2019/0314903 A1 10/2019 Haenle et al.
2020/0000595 A1 1/2020 Jones et al.
2020/0278016 A1 9/2020 Hofmann et al.
2020/0278017 A1 9/2020 Hofmann et al.
2020/0282582 A1 9/2020 Hofmann et al.
2020/0284146 A1 9/2020 Yahnker et al.
2020/0318721 A1 10/2020 Hofmann et al.
2020/0406579 A1 12/2020 Hahnlen

FOREIGN PATENT DOCUMENTS

CN 103153502 A 6/2013
CN 203227820 U 10/2013
DE 102010062089 A1 5/2012
DE 112018001284 T5 11/2019
EP 0127366 A1 5/1984
EP 1063312 A1 12/2000
EP 1138798 A1 10/2001
EP 1696153 A1 8/2006
EP 1404884 B1 7/2007
EP 1944138 A2 7/2008
EP 3630392 A1 4/2020
EP 3630395 A1 4/2020
EP 3630397 A2 4/2020
JP 60116775 A 6/1985
JP 61276762 A 12/1986
JP 62-227070 A * 10/1987 ..... C22F 1/00
JP 09121094 A 5/1997
JP 2002045960 A 2/2002
JP 2004315340 A 11/2004
JP 2004353053 A 12/2004
JP 2007040517 A 2/2007
JP 2007040518 A 2/2007
JP 2007247037 A 9/2007
JP 2008115932 A 5/2008
JP 2008264865 A 11/2008
JP 2011045931 A 3/2011
JP 2012046826 A 3/2012
JP 2012162805 A 8/2012
JP 2013057397 A 3/2013
JP 5249932 B2 7/2013
JP 2013238278 A 11/2013
JP 2013544648 A 12/2013
JP 2018149655 A 9/2018
KR 101420176 B1 7/2014
KR 1020190119154 A 10/2019
KR 1020200004435 A 1/2020
KR 1020200011470 A 2/2020
WO 2005/077560 A1 * 8/2005 ..... B21D 17/02
WO 2006073428 A2 7/2006
WO 2007038882 A1 4/2007
WO 2008058896 A1 5/2008
WO 2008156889 A2 12/2008
WO 2009069716 A1 6/2009
WO 2010027317 A1 3/2010
WO 2011159596 A1 12/2011
WO 2012031022 A2 3/2012
WO 2012083922 A1 6/2012
WO 2012147559 A1 11/2012
WO 2013138710 A1 9/2013
WO 2013141878 A1 9/2013
WO 2013141882 A1 9/2013
WO 2014004704 A1 1/2014
WO 2014012113 A2 1/2014
WO 2014058498 A3 4/2014
WO 2015042437 A1 3/2015
WO 2015156797 A1 10/2015
WO 2016116562 A1 7/2016

(56) References Cited

FOREIGN PATENT DOCUMENTS

| | | | |
|---|---|---|---|
| WO | 2018165662 | A1 | 9/2018 |
| WO | 2018218077 | A1 | 11/2018 |
| WO | 2018218247 | A1 | 11/2018 |
| WO | 2018223117 | A2 | 12/2018 |
| WO | 2018223117 | A3 | 1/2019 |

OTHER PUBLICATIONS

Sun et al., "Fiber metallic glass laminates", Dec. 2010, J. Mater. Res., vol. 25, No. 12, pp. 2287-2291.
Extended European Search Report for European Application No. 14889035.3, Search completed Dec. 4, 2017, dated Dec. 13, 2017, 10 Pgs.
International Preliminary Report on Patentability for International Application PCT/US2013/047950, dated Dec. 31, 2014, dated Jan. 8, 2015, 7 Pgs.
International Preliminary Report on Patentability for International Application PCT/US2013/050614, dated Jan. 20, 2015, dated Jan. 29, 2015, 9 Pgs.
International Preliminary Report on Patentability for International Application PCT/US2014/033510, dated Oct. 12, 2016, dated Oct. 20, 2016, 9 Pgs.
International Preliminary Report on Patentability for International Application PCT/US2014/056615, dated Mar. 22, 2016, dated Mar. 31, 2016, 11 Pgs.
International Search Report and Written Opinion for International Application No. PCT/US2013/050614, Completed May 7, 2014, dated May 7, 2014, 12 pgs.
International Search Report and Written Opinion for International Application PCT/US2013/047950, completed Oct. 8, 2013, dated Oct. 10, 2013, 9 pgs.
International Search Report and Written Opinion for International Application PCT/US2014/033510, completed Jan. 8, 2015, dated Jan. 8, 2015, 11 Pgs.
International Search Report and Written Opinion for International Application PCT/US2014/056615, completed Dec. 29, 2014, dated Dec. 30, 2014, 13 Pgs.
"Corrosion of Titanium and Titanium Alloys", Total Materia., printed Feb. 16, 2016 from http://www.totalmateria.com/Article24.htm, published Sep. 2001, 4 pgs.
"Gear", Dictionary.com. Accessed Aug. 30, 2016.
"Group 4 element", Wkipedia. https://en.wikipedia.org/wiki/Group_ 4_element. Published Jun. 11, 2010. Accessed Aug. 24, 2016.
"Harmonic Drive AG", website, printed from http://harmoncdrive.aero/?idcat=471, Feb. 20, 2014, 2 pgs.
"Harmonic Drive Polymer GmbH", printed Feb. 20, 2014 from http://www.harmonicdrive.de/English/the-company/subsidiaries/harmonic-drive-polymer-gmbh.html, 1 pg.
"Introduction to Thermal Spray Processing", ASM International, Handbook of Thermal Spray Technology (#06994G), 2004, 12 pgs.
Abdeljawad et al., "Continuum Modeling of Bulk Metallic Glasses and Composites", Physical Review Letters, vol. 105, 205503, Sep. 17, 2010, pp. 125503-1-125503-4.
Abrosimova et al., "Crystalline layer on the surface of Zr-based bulk metallic glasses", Journal of Non-Crystalline solids, Mar. 6, 2001, vol. 288, pp. 121-126.
An et al., "Synthesis of single-component metallic glasses by thermal spray of nanodroplets on amorphous substrates", Applied Physics Letters, Jan. 26, 2012, vol. 100, pp. 041909-1-041909-4.
Anstis et al., "A Critical Evaluation of Indentation Techniques for Measuring Fracture Toughness: I, Direct Crack Measurements", Journal of American Ceramic Society, Sep. 1, 1981, vol. 64, No. 8, pp. 533-538.
Ashby et al., "Metallic glasses of structural materials", Scripta Materialia, Feb. 2006, vol. 54, pp. 321-326.
Bakkal., "Sliding tribological characteristics of Zr-based bulk metallic glass under lubricated conditions", Intermetallics, Mar. 19, 2010, vol. 18, pp. 1251-1253.
Bardt et al., "Micromolding three-dimensional amorphous metal structures", J. Mater. Res, Feb. 2007, vol. 22, No. 2, pp. 339-343.
Basu et al., "Laser surface coating of Fe—Cr—Mo—Y—B—C bulk metallic glass composition on AISI 4140 steel", Surface & Coatings Technology, Mar. 15, 2008, vol. 202, pp. 2623-2631.
Boopathy et al., "Near-threshold fatigue crack growth in bulk metallic glass composites", J. Mater. Res., vol. 24, No. 12, pp. 3611-3619, Dec. 2009.
Branagan et al., "Wear Resistant Amorphous and Nanocomposite Steel Coatings", Met. Mater. Trans. A, Apr. 26, 2001, 32A; Idaho National Engineering and Environmental Laboratory, DOI 10.1007/s11661-001-0051-8, 15 pgs., Oct. 1, 2001.
Cadney et al., "Cold gas dynamic spraying as a method for freeforming and joining materials", Science Direct, Surface & Coatings Technology, Mar. 15, 2008, vol. 202, pp. 2801-2806.
Calin et al., "Improved mechanical behavior of Cu—Ti-based bulk metallic glass by in situ formation of nanoscale precipitates", Scripta Materialia, Mar. 17, 2003, vol. 48, pp. 653-658.
Kobayashi et al., "Property of Ni-Based Metallic Glass Coating Produced by Gas Tunnel Type Plasma Spraying", International Plasma Chemistry Society, ISPC 20, 234, Philadelphia, USA, Jul. 24, 2011, Retrieved from: http://www.ispc-conference.org/ispcproc/ispc20/234.pdf.
Kong et al., "Effect of Flash Temperature on Tribological Properties of Bulk Metallic Glasses", Tribol. Lett., Apr. 25, 2009, vol. 35, pp. 151-158.
Kozachkov et al., "Effect of cooling rate on the vol. fraction of B2 phases in a CuZrAlCo metallic glass matrix composite", Intermetallics, Apr. 19, 2013, vol. 39, pp. 89-93.
Kuhn et al., "Microstructure and mechanical properties of slowly cooled Zr—Nb—Cu—Ni—Al composites with ductile bcc phase", Materials Science and Engineering: A, Jul. 2004, vol. 375-377, pp. 322-326.
Kuhn et al., "ZrNbCuNiAl bulk metallic glass matrix composites containing dendritic bcc phase precipitates", Applied Physics Letters, Apr. 8, 2002, vol. 80, No. 14, pp. 2478-2480.
Kumar et al., "Bulk Metallic Glass: The Smaller the Better", Advanced Materials, Jan. 25, 2011, vol. 23, pp. 461-476.
Kwon et al., "Wear behavior of Fe-based bulk metallic glass composites", Journal of Alloys and Compounds, Jul. 14, 2011, vol. 509S, pp. S105-S108.
Launey et al., "Fracture toughness and crack-resistance curve behavior in metallic glass-matrix composites", Applied Physics Letters, Jun. 18, 2009, vol. 94, pp. 241910-1-241910-3.
Launey et al., "Solution to the problem of the poor cyclic fatigue resistance of bulk metallic glasses", PNAS Early Edition, pp. 1-6, Jan. 22, 2009.
Lee et al., "Effect of a controlled volume fraction of dendritic phases on tensile and compressive ductility in La-based metallic glass matrix composites", Acta Materialia, vol. 52, Issue 14, Jun. 17, 2004, pp. 4121-4131.
Lee et al., "Nanomechanical properties of embedded dendrite phase and its influence on inelastic deformation of Zr55Al10Ni5Cu30 glassy alloy", Materials Science and Engineering A, Mar. 25, 2007, vol. 375, pp. 945-948.
Li et al., "Wear behavior of bulk Zr41Ti14Cu12.5Ni10Be22.5 metallic glasses", J. Mater. Res., Aug. 2002, vol. 17, No. 8, pp. 1877-1880.
Lillo et al., "Microstructure, Processing, Performance Relationships for High Temperature Coatings", U.S. Department of Energy, Office of Fossil Energy, under DOE Idaho Operations Office, Contract DE-AC07-05ID14517; 22nd Annual Conference on Fossil Energy Materials, Pittsburgh, U.S., 8 pgs., Jul. 1, 2008.
List, A. et al. , "Impact Conditions for Cold Spraying of Hard Metallic Glasses", Journal of Thermal Spray Technology, Jun. 1, 2012, vol. 21, No. 3-4, pp. 531-540.
Liu, X. Q. , "Microstructure and properties of Fe-based amorphous metallic coating produced by high velocity axial plasma spraying", Science Direct, Journal of Alloys and Compounds, Apr. 23, 2009, vol. 484, pp. 300-307.
Liu et al., "Influence of Heat Treatment on Microstructure and Sliding Wear of Thermally Sprayed Fe-Based Metallic Glass coatings", Tribol. Lett, Mar. 4, 2012, vol. 46, pp. 131-138.

(56) References Cited

OTHER PUBLICATIONS

Liu et al., "Metallic glass coating on metals plate by adjusted explosive welding technique", Applied Surface Science, Jul. 16, 2009, vol. 255, pp. 9343-9347.
Liu et al., "Sliding Tribological Characteristics of a Zr-based Bulk Metallic Glass Near the Glass Transition Temperature", Tribol. Lett., Jan. 29, 2009, vol. 33, pp. 205-210.
Liu et al., "Wear behavior of a Zr-based bulk metallic glass and its composites", Journal of Alloys and Compounds, May 5, 2010, vol. 503, pp. 138-144.
Lupoi, R. et al. , "Deposition of metallic coatings on polymer surfaces using cold spray", Science Direct, Surface & Coatings Technology, Sep. 6, 2010, vol. 205, pp. 2167-2173.
Ma et al., "Wear resistance of Zr-based bulk metallic glass applied in bearing rollers", Materials Science and Engineering, May 4, 2004, vol. A386, pp. 326-330.
Maddala et al., "Effect of notch toughness and hardness on sliding wear of Cu50Hf41.5A18.5 bulk metallic glass", Scripta Materialia, Jul. 6, 2011, vol. 65, pp. 630-633.
Narayan et al., "On the hardness and elastic modulus of bulk metallic glass matrix composites", Scripta Materialia, Jun. 9, 2010, vol. 63, Issue 7, pp. 768-771.
Ni et al., "High performance amorphous steel coating prepared by HVOF thermal spraying", Journal of Alloys and Compounds, Jan. 7, 2009, vol. 467, pp. 163-167, Nov. 29, 2007.
Nishiyama, N. et al. , "Recent progress of bulk metallic glasses for strain-sensing devices", Materials Science and Engineering: A, vols. 449-451, Mar. 25, 2007, 79-83.
Oh et al., "Microstructure and tensile properties of high-strength high-ductility Ti-based amorphous matrix composites containing ductile dendrites", Acta Materialia, Sep. 23, 2011, vol. 59, Issue 19, pp. 7277-7286.
Parlar et al., "Sliding tribological characteristics of Zr-based bulk metallic glass", Intermetallics, Jan. 2008, vol. 16, pp. 34-41.
Pauly et al., "Modeling deformation behavior of Cu—Zr—Al bulk metallic glass matrix composites", Applied Physics Letters, Sep. 2009, vol. 95, pp. 101906-1-101906-3.
Pauly et al., "Transformation-mediated ductility in CuZr-based bulk metallic glasses", Nature Materials, May 16, 2010, vol. 9, Issue 6, pp. 473-477.
Ponnambalam, et al., "Fe-based bulk metallic glasses with diameter thickness larger than one centimeter", J Mater Res, Feb. 17, 2004. vol. 19; pp. 1320-1323.
Porter et al., "Incorporation of Amorphous Metals into MEMS for High Performance and Reliability", Rockwell Scientific Company, Final Report, Nov. 1, 2003, 41 pgs.
Prakash et al., "Sliding wear behavior of some Fe-, Co- and Ni-based metallic glasses during rubbing against bearing steel", Tribology Letters, May 1, 2000, vol. 8, pp. 153-160.
Qiao et al., "Development of plastic Ti-based bulk-metallic-glass-matrix composites by controlling the microstructures", Materials Science and Engineering: A, Aug. 20, 2010, vol. 527, Issues 29-30, pp. 7752-7756.
Ramamurty et al., "Hardness and plastic deformation in a bulk metallic glass", Acta Materialia, Feb. 2005, vol. 53, pp. 705-717.
Revesz et al., "Microstructure and morphology of Cu—Zr—Ti coatings produced by thermal spray and treated by surface mechanical attrition", ScienceDirect, Journal of Alloys and Compounds, Jul. 14, 2011, vol. 509S, pp. S482-S485, Nov. 4, 2010.
Rigney et al., "The Evolution of Tribomaterial During Sliding: A Brief Introduction", Tribol. Lett, Jul. 1, 2010, vol. 39, pp. 3-7.
Roberts et al., "Cryogenic Charpy impact testing of metallic glass matrix composites", Scripta Materialia, Nov. 11, 2011, 4 pgs.
Schuh et al., "A survey of instrumented indentation studies on metallic glasses", J. Mater. Res., Jan. 2004, vol. 19, No. 1, pp. 46-57.
Segu et al., "Dry Sliding Tribological Properties of Fe-Based Bulk Metallic Glass", Tribol. Lett., Apr. 28, 2012, vol. 47, pp. 131-138.
Shen et al., "Exceptionally high glass-forming ability of an FeCoCrMoCBY alloy", Applied Physics, Apr. 5, 2005, vol. 86, pp. 151907-1-151907-3.
Singer et al., "Wear behavior of triode-sputtered MoS2 coatings in dry sliding contact with steel and ceramics", Wear, Jul. 1996, vol. 195, Issues 1-2, pp. 7-20.
Sinmazcelik et al., "A review: Fibre metal laminates, background, bonding types and applied test methods", Materials and Design, vol. 32, Issue 7, 3671, Mar. 4, 2011, pp. 3671-3685.
Song et al., "Strategy for pinpointing the formation of B2 CuZr in metastable CuZr-based shape memory alloys", Acta Materialia, Aug. 6, 2011, vol. 59, pp. 6620-6630.
Sundaram et al., "Mesoscale Folding, Instability, and Disruption of Laminar Flow in Metal Surfaces", Physical Review Letters, Sep. 7, 2012, vol. 109, pp. 106001-1-106001-5.
Szuecs Et al., "Mechanical Properties of Zr56.2Ti13.8Nb5.0Cu6.9Ni5.6Be12.5 Ductile Phase Reinforced Bulk Metallic Glass Composite", Acta Materialia, Feb. 2, 2001, vol. 49, Issue 9, pp. 1507-1513.
Tam et al., "Abrasion resistance of Cu based bulk metallic glasses", Journal of Non-Crystalline Solids, Oct. 18, 2004, vol. 347, pp. 268-272.
Tam et al., "Abrasive wear of Cu60Zr30Ti10 bulk metallic glass", Materials Science and Engineering, Apr. 1, 2004, vol. A384 pp. 138-142.
Tan et al., "Synthesis of La-based in-situ bulk metallic glass matrix composite", Intermetallics, Nov. 2002, vol. 10, Issues 11-12, pp. 1203-1205.
Tao et al., "Effect of rotational sliding velocity on surface friction and wear behavior in Zr-based bulk metallic glass", Journal of Alloys and Compounds, Mar. 4, 2010, vol. 492, pp. L36-L39.
Tao et al., "Influence of isothermal annealing on the micro-hardness and friction property in CuZrAl bulk metallic glass", Advanced Materials Research, Jan. 1, 2011, vols. 146-147, pp. 615-618.
Tobler et al., "Cryogenic Tensile, Fatigue, and Fracture Parameters for a Solution-Annealed 18 Percent Nickel Maraging Steel", Journal of Engineering Materials and Technology, Apr. 1, 1978, vol. 100, pp. 189-194.
Wagner, "Mechanical Behavior of 18 Ni 200 Grade Maraging Steel at Cyrogenic Temperatures", J Aircraft, Nov. 1, 1986, vol. 23, No. 10, pp. 744-749.
Wang et al., "Progress in studying the fatigue behavior of Zr-based bulk-metallic glasses and their composites", Intermetallics, Mar. 6, 2009, vol. 17, pp. 579-590.
Wkipedia, "Harmonic Drive", printed Feb. 20, 2014, 4 pgs.
Chen et al., "Elastic Constants, Hardness and Their Implications to Flow Properties of Metallic Glasses", Journal of Non-crystalline Solids, Sep. 1, 1975, vol. 18, pp. 157-171.
Chen et al., "Formation of Micro-Scale Precision Flexures Via Molding of Metallic Glass", Proceeding of the Annual Meeting of the ASPE, Monterey, CA, 2006, pp. 283-286.
Chen et al., "Influence of laser surface melting on glass formation and tribological behaviors of Zr55Al10Ni5Cu30 alloy", J. Mater Res. Oct. 28, 2011, vol. 26, No. 20, pp. 2642-2652.
Cheng, J. B. , "Characterization of mechanical properties of FeCrBSiMnNbY metallic glass coatings", J Mater Sci., Apr. 16, 2009, vol. 44, pp. 3356-3363.
Cheng et al., "Correlation of the microstructure and mechanical properties of Zr-based in-situ bulk metallic glass matrix composites", Intermetallics, Sep. 24, 2010, vol. 18, Issue 12, pp. 2425-2430.
Choi et al., "Tribological behavior of the kinetic sprayed Ni59Ti16Zr20Si2Sn3", Journal of Alloys and Compounds, May 31, 2007, vol. 434-435, pp. 64-67.
Conner et al., "Shear band spacing under bending of Zr-based metallic glass plates", Acta Materialia, Jan. 27, 2004, vol. 52, pp. 2429-2434.
Conner et al., "Shear bands and cracking of metallic glass plates in bending", Journal of Applied Physics, Jul. 15, 2003, vol. 94, No. 2, pp. 904-911.
Dai et al., "A new centimeter-diameter Cu-based bulk metallic glass", Scripta Materialia, Jan. 20, 2006, vol. 54, pp. 1403-1408.
Davis, "Hardness/Strength Ratio of Metallic Glasses", Scripta Metallurgica, Feb. 18, 1975, vol. 9, pp. 431-436.

(56) References Cited

OTHER PUBLICATIONS

De Beer et al., "Surface Folds Make Tears and Chips", Physics, Sep. 4, 2012, vol. 100, 3 pgs.
Demetriou et al., "Glassy steel optimized for glass-forming ability and toughness", Applied Physics Letters, Jul. 31, 2009, vol. 95; pp. 041907-1-041907-3; http:/idx.doi.org/10.1063/1.3184792.
Dislich et al., "Amorphous and Crystalline Dip Coatings Obtained from Organometallic Solutions: Procedures, Chemical Processes and Products", Metallurgical and Protective Coatings, Mar. 6, 1981, vol. 77, pp. 129-139.
Duan et al., "Lightweight Ti-based bulk metallic glasses excluding late transition metals", Scripta Materialia, Mar. 2008, vol. 58, pp. 465-468.
Duan et al., "Tribological properties of Zr41.25Ti13.75Ni10Cu12.5Be22.5 bulk metallic glasses under different conditions", Journal of Alloys and Compounds, Mar. 2, 2012, 528. pp. 74-78.
Fan et al., "Metallic glass matrix composite with precipitated ductile reinforcement", Applied Physics Letters, Aug. 5, 2002, vol. 81, Issue 6, pp. 1020-1022.
Fleury et al., "Tribological properties of bulk metallic glasses", Materials Science and Engineering, Jul. 2004, vol. A375-A377, pp. 276-279.
Fornell et al., "Enhanced mechanical properties and in vitro corrosion behavior of amorphous and devitrified Ti40Zr10Cu38Pd12 metallic glass", Journal of the Mechanical Behavior of Biomedical Materials, May 27, 2011, vol. 4, pp. 1709-1717.
Fu et al., "Sliding behavior of metallic glass Part I, Experimental investigations", Wear, Oct. 2001, vol. 250, pp. 409-419.
Ganesan et al., "Bonding behavior studies of cold sprayed copper coating on the PVC polymer substrate", Surface & Coatings Technology, Jul. 10, 2012, vol. 207, pp. 262-269.
Garrett et al., "Effect of microalloying on the toughness of metallic glasses", Applied Physics Letter, Dec. 12, 2012, vol. 101, 241913-1-241913-3.
Gleason Corporation, "Gear Product News", Introducing genesis, The Next Generation in Gear Technology, Apr. 2006, 52 pgs.
Gloriant, "Microhardness and abrasive wear resistance of metallic glasses and nanostructured composite materials", Journal of Non-Crystalline Solids, Feb. 2003, vol. 316, pp. 96-103.
Greer, "Partially or fully devitrified alloys for mechanical properties", Materials and Science and Engineering, May 31, 2001, vol. A304, pp. 68-72.
Greer et al., "Wear resistance of amorphous alloys and related materials", International Materials Reviews, Apr. 1, 2002, vol. 47, No. 2, pp. 87-112.
Ha et al., "Tensile deformation behavior of two Ti-based amorphous matrix composites containing ductile β dendrites", Materials Science and Engineering: A, May 28, 2012, vol. 552, pp. 404-409.
Hale, "Principles and Techniques for Designing Precision Machines", Ph.D. Thesis, Feb. 1999, 493 pgs.
Harmon et al., "Anelastic to Plastic Transition in Metallic Glass-Forming Liquids", Physical Review Letters, Sep. 28, 2007, vol. 99, 135502-1-135502-4.
Haruyama et al., "Volume and enthalpy relaxation in Zr55Cu30Ni5Al10 bulk metallic glass", Acta Materialia, Mar. 2010, vol. 59, pp. 1829-1836.
Hays, C. C. , "Microstructure Controlled Shear Band Pattern Formation and Enhanced Plasticity of Bulk Metallic Glasses Containing in situ Formed Ductile Phase Dendrite Dispersions", Physical Review Letters, Mar. 27, 2000, vol. 84, pp. 2901-2904.
Hejwowski et al., "A comparative study of electrochemical properties of metallic glasses and weld overlay coatings", Vacuum, Feb. 2013, vol. 88, pp. 118-123, Feb. 20, 2012.
Hofmann, "Bulk Metallic Glasses and Their Composites: A Brief History of Diverging Fields", Journal of Materials, Jan. 2013, vol. 2013, 7 pgs.
Hofmann, "Shape Memory Bulk Metallic Glass Composites", Science, Sep. 10, 2010, vol. 329, pp. 1294-1295.
Hofmann, D. C. , "Development of tough, low-density titanium-based bulk metallic glass matrix composites with tensile ductility", PNAS, Dec. 23, 2008, vol. 105, pp. 20136-20140.
Hofmann et al., "Designing metallic glass matrix composites with high toughness and tensile ductility", Nature Letters, Feb. 28, 2008, vol. 451, pp. 1085-1090.
Hofmann et al., "Improving Ductility in Nanostructured Materials and Metallic Glasses: Three Laws", Material Science Forum, vol. 633-634, 2010, pp. 657-663, published online Nov. 19, 2009.
Hofmann et al., "Semi-solid Induction Forging of Metallic Glass Matrix Composites", JOM, Dec. 2009, vol. 61, No. 12, pp. 11-17, plus cover.
Hong et al., "Microstructural characteristics of high-velocity oxygen-fuel (HVOF) sprayed nickel-based alloy coating", Journal of Alloys and Compounds, Jul. 26, 2013, vol. 581, pp. 398-403.
Hu et al., "Crystallization Kinetics of the Cu47.5Zr74.5Al5 Bulk Metallic Glass under Continuous and Iso-thermal heating", App. Mech. and Materials, vols. 99-100, Sep. 8, 2011, p. 1052-1058.
Huang et al., "Dendritic microstructure in the metallic glass matrix composite Zr56Ti14Nb5Cu7Ni6Be12", Scripta Materialia, Mar. 29, 2005, vol. 53, pp. 93-97.
Huang et al., "Fretting wear behavior of bulk amorphous steel", Intermetallics, Jun. 12, 2011, vol. 19, pp. 1385-1389.
Inoue et al., "Cobalt-based bulk glassy alloy with ultrahigh strength and soft magnetic properties", Nature Materials, Sep. 21, 2003, vol. 2, pp. 661-663.
Inoue et al., "Development and applications of late transition metal bulk metallic glasses", Bulk Metallic Glasses, pp. 1-25, 2008.
Inoue et al., "Developments and applications of bulk metallic glasses", Rev. Adv. Mater. Sci., Feb. 28, 2008, vol. 18, No. 1., pp. 1-9.
Inoue et al., "Preparation of 16 mm diameter Rod of Amorphous Zr65Al7.5Ni10Cu17.5 Alloy", Material Transactions, JIM, 1993, vol. 34, No. 12, pp. 1234-1237.
Inoue et al., "Recent development and application products of bulk glassy alloys", Acta Materialia, Jan. 20, 2011, vol. 59, Issue 6, pp. 2243-2267.
Ishida et al., "Wear resistivity of super-precision microgear made of Ni-based metallic glass", Materials Science and Engineering, Mar. 25, 2007, vol. A449-451, pp. 149-154.
Jiang et al., "Low-Density High-Strength Bulk Metallic Glasses and Their Composites: A Review", Advanced Engineering Materials, Nov. 19, 2014, pp. 1-20, DOI: 10.1002/adem.201400252.
Jiang et al., "Tribological Studies of a Zr-Based Glass-Forming Alloy with Different States", Advanced Engineering Materials, Sep. 14, 2009, vol. 1, No. 11, pp. 925-931.
Kahraman et al., "A Feasibility Study on Development of Dust Abrasion Resistant Gear Concepts for Lunar Vehicle Gearboxes", NASA Grant NNX07AN42G Final Report, Mar. 11, 2009, 77 pgs.
Kim, Junghwan et al. , "Oxidation and crystallization mechanisms in plasma-sprayed Cu-based bulk metallic glass coatings", Acta Materialia., Feb. 1, 2010, vol. 58, pp. 952-962.
Kim et al., "Amorphous phase formation of Zr-based alloy coating by HVOF spraying process", Journal of Materials Science, Jan. 1, 2001, vol. 36, pp. 49-54.
Kim et al., "Enhancement of metallic glass properties of Cu-based BMG coating by shroud plasma spraying", Science Direct, Surface & Coatings Technology, Jan. 25, 2011, vol. 205, pp. 3020-3026, Nov. 6, 2010.
Kim et al., "Production of Ni65Cr15P16B4 Metallic Glass-Coated Bipolar Plate for Fuel Cell by High Velocity Oxy-Fuel (HVOF) Spray Coating Method", The Japan Institute of Metals, Materials Transactions, Aug. 25, 2010, vol. 51, No. 9. pp. 1609-1613.
Kim et al., "Realization of high tensile ductility in a bulk metallic glass composite by the utilization of deformation-induced martensitic transformation", Scripta Materialia, May 3, 2011, vol. 65, pp. 304-307.
Kim et al., "Weldability of Cu54Zr22Ti18Ni6 bulk metallic glass by ultrasonic welding processing", Materials Letters, May 17, 2014, 130, pp. 160-163.
Kobayashi et al., "Fe-based metallic glass coatings produced by smart plasma spraying process", Materials Science and Engineering, Feb. 25, 2008, vol. B148, pp. 110-113.

(56) References Cited

OTHER PUBLICATIONS

Kobayashi et al., "Mechanical property of Fe-base metallic glass coating formed by gas tunnel type plasma spraying", ScienceDirect, Surface & Coatings Technology, Mar. 14, 2008, 6 pgs.
Bordeenithikasem et al., "Glass forming ability, flexural strength, and wear properties of additively manufactured Zr-based bulk metallic glasses produced through laser powder bed fusion", Additive Manufacturing, Mar. 21, 2018, vol. 21, pp. 312-317.
Dai et al., "High-performance bulk Ti—Cu—Ni—Sn—Ta nanocomposites based on a dendrite-eutectic microstructure", Journal of Materials Research, Sep. 2004, vol. 19, No. 9, pp. 2557-2566.
Guo et al., "Tensile ductility and necking of metallic glass", Nature Materials, Oct. 2007, vol. 6, pp. 735-739.
He et al., "Novel Ti-base nanostructure—dendrite composite with enhanced plasticity", Nature Materials, Jan. 2003, Published Dec. 8, 2002, vol. 2, pp. 33-37, doi: 10.1038/nmat792.
Johnson et al., "Quantifying the Origin of Metallic Glass Formation", Nature Communications, Jan. 20, 2016, vol. 7, 10313, 7 pgs. doi: 10.1038/ncomms10313.
Jung et al., "Fabrication of Fe-based bulk metallic glass by selective laser melting: A parameter study", Materials and Design, Jul. 30, 2015, vol. 86, pp. 703-708.
Kim et al., "Design and synthesis of Cu-based metallic glass alloys with high glass forming ability", Journal of Metastable and Nanocrystalline Materials, vols. 24-25, pp. 93-96. Online Sep. 1, 2005. (Year: 2005).
Li et al., "Selective laser melting of Zr-based bulk metallic glasses: Processing, microstructure and mechanical properties", Materials and Design, Sep. 21, 2016, vol. 112, pp. 217-226.
Lin et al., "Designing a toxic-element-free Ti-based amorphous alloy with remarkable supercooled liquid region for biomedical application", Intermetallics, Jul. 9, 2014, vol. 55, pp. 22-27.
Mahbooba et al., "Additive manufacturing of an iron-based bulk metallic glass larger than the critical casting thickness", Applied Materials Today, Feb. 27, 2018, vol. 11, pp. 264-269.
Pauly et al., "Processing Metallic Glasses by Selective Laser Melting", Materials Today, Jan./Feb. 2013, vol. 16, pp. 37-41.
Shen et al., "3D printing of large, complex metallic glass structures", Materials and Design, Mar. 2017, vol. 117, pp. 213-222.
Whang et al., "Microstructures and age hardening of rapidly quenched Ti—Zr—Si alloys", Journal of Materials Science Letters, 1985, vol. 4, pp. 883-887.
Wu et al., "Bulk Metallic Glass Composites with Transformation-Mediated Work-Hardening and Ductility", Advanced Materials, Apr. 26, 2010, vol. 22, p. 2270-2773.
Wu et al., "Dry Sliding tribological behavior of Zr-based bulk metallic glass", Transactions of Nonferrous Metals Society of China, Jan. 16, 2012, vol. 22, Issue 3, pp. 585-589.
Wu et al., "Effects of environment on the sliding tribological behaviors of Zr-based bulk metallic glass", Intermetallics, Jan. 27, 2012, vol. 25, pp. 115-125.
Wu et al., "Formation of Cu—Zr—Al bulk metallic glass composites with improved tensile properties", Acta Materialia 59, Feb. 19, 2011, pp. 2928-2936.
Wu et al., "Use of rule of mixtures and metal volume fraction for mechanical property predictions of fibre-reinforced aluminum laminates", Journal of Materials Science, vol. 29, issue 17, 4583, Jan. 1994, 9 pages.
Yin, Enhuai et al., "Microstructure and mechanical properties of a spray-formed Ti-based metallic glass former alloy", Journal of Alloys and Compounds, Jan. 25, 2012, vol. 512, pp. 241-245.
Zachrisson et al., "Effect of Processing on Charpy impact toughness of metallic glass matrix composites", Journal of Materials Research, vol. 26, No. 10, May 28, 2011; abstract; p. 1263, paragraphs 2-3; p. 1265, col. 2, paragraph 2.
Zhang et al., "Abrasive and corrosive behaviors of Cu—Zr—Al—Ag—Nb bulk metallic glasses", Journal of Physics: Conference Series, 2009, vol. 144, pp. 1-4.
Zhang et al., "Robust hydrophobic Fe-based amorphous coating by thermal spraying", Appl. Phys. Lett., Sep. 20, 2012, vol. 101, pp. 121603-1-121603-4.
Zhang et al., "Wear behavior of a series of Zr-based bulk metallic glasses", Materials Science and Engineering, Feb. 25, 2008, vol. A475, pp. 124-127.
Zhou et al., "Microstructure and Electrochemical Behavior of Fe-Based Amorphous Metallic Coatings Fabricated by Atmospheric Plasma Spraying", Journal of Thermal Spray Technology, Jan. 2011, vol. 20, No. u-2, pp. 344-350, Aug. 17, 2010.
Zhu et al., "Ta-particulate reinforced Zr-based bulk metallic glass matrix composite with tensile plasticity", Scripta Materialia, Mar. 2010, vol. 62, Issue 5, pp. 278-281.
Zhuo, et al., "Spray formed Al-based amorphous matrix nanocomposite plate", ScienceDirect, Journal of Alloys and Compounds, Mar. 1, 2011, vol. 509, pp. L169-L173.
Extended European Search Report for European Application No. 18806700.3, Search completed Oct. 20, 2020, dated Oct. 28, 2020, 7 Pgs.
Extended European Search Report for European Application No. 18809486.6, Search completed Sep. 30, 2030, dated Oct. 12, 2020, 7 Pgs.
International Preliminary Report on Patentability for International Application PCT/US2018/035813, Report dated Dec. 3, 2019, dated Dec. 12, 2019, 9 Pgs.
International Preliminary Report on Patentability for International Application PCT/US2018/022020, Report dated Sep. 10, 2019, dated Sep. 19, 2019, 10 Pgs.
International Preliminary Report on Patentability for International Application PCT/US2018/034481, Report dated Nov. 26, 2019, dated Dec. 5, 2019, 17 Pgs.
International Preliminary Report on Patentability for International Application PCT/US2018/034924, Report dated Nov. 26, 2019, dated Dec. 5, 2019, 13 Pgs.
International Search Report and Written Opinion for International Application No. PCT/US2018/022020, Search completed Jul. 2, 2018, dated Jul. 3, 2018, 12 Pgs.
International Search Report and Written Opinion for International Application No. PCT/US2018/034481, Search completed Sep. 10, 2018, dated Sep. 10, 2018, 19 Pgs.
International Search Report and Written Opinion for International Application No. PCT/US2018/034924, Search completed Sep. 18, 2018, dated Sep. 19, 2018, 15 Pgs.
International Search Report and Written Opinion for International Application No. PCT/US2018/035813, Search completed Dec. 12, 2018, dated Dec. 12, 2018, 11 Pgs.
Berger, "A Survey of Additive Manufacturing Processes Applied on the Fabrication of Gears", 1st International Conference on Progress in Additive Manufacturing (Pro-AM 2014), May 26-28, 2014, pp. 315-320, doi: 10.3850/978-981-09-0446-3_010.
Byrne et al., "Bulk Metallic Glasses", Science, Jul. 25, 2008, vol. 321, pp. 502-503, doi:10.1126/science.1158864.
Gu et al., "Selective Laser Melting Additive Manufacturing of Ti-Based Nanocomposites: The Role of Nanopowder", Metallurgical and Materials Transactions A, Jan. 2014, vol. 45, pp. 464-476, DOI: 10.1007/s11661-013-1968-4.
Kumar et al., "Embrittlement of Zr-based Bulk Metallic Glasses", Science Direct, Acta Materialia, 2009, vol. 57, pp. 3572-3583, available online May 11, 2009, doi:10.1016/j.actamat.2009.04.16.
Lu et al., "Crystallization Prediction on Laser Three-Dimensional Printing of Zr-based Bulk Metallic Glass", Journal of Non-Crystalline Solids, 2017, vol. 461, pp. 12-17, available online Jan. 29, 2017, http://dx.doi.org/10.1016/j.jnoncrysol.2017.01.038.
Madge, "Toughness of Bulk Metallic Glasses", Metals, Jul. 17, 2015, vol. 5, Issue 3, pp. 1279-1305, ISSN 2075-4701, doi:10.3390/met5031279., Per Nov. 23, 2020 KR Receiving Office email, there is an error in this ref as cited in the Sep. 10, 2018 ISR. pp. 1127-1769 is not correct. pp. 1279-1305 is the correct page range for this reference.
Qiao et al., "Metallic Glass Matrix Composites", Materials Science and Engineering, Feb. 2016, vol. 100, pp. 1-69, http://dx.doi.org.10.10163/jmser.2015.12.001.

(56) References Cited

OTHER PUBLICATIONS

Yao et al., "Fe-Based Bulk Metallic Glass with High Plasticity", Applied Physics Letters, Feb. 5, 2007, vol. 90, 061901, doi: 10.1063/1.2437722.
Yokoyama et al., "Tough Hypoeutectic Zr-Based Bulk Metallic Glasses", Metallurgical and Materials Transactions, Year 2011, vol. 42A, pp. 1468-1475, DOI: 10.1007/s11661-011-0631-1.
Zhuo et al., "Ductile Bulk Aluminum-Based Alloy with Good Glass-Forming Ability and High Strength", Chinese Physics Letters, 2009, vol. 26, No. 6, pp. 066402-1-066402-4.
Final Office Action on U.S. Appl. No. 14/163,936, dated Mar. 10, 2016, 13 pgs.
Non-Final Office Action on U.S. Appl. No. 14/163,936, dated Sep. 10, 2015, 10 pgs.
Notice of Allowance on U.S. Appl. No. 14/163,936, dated Oct. 13, 2016, 10 pgs.
Adharapurapu et al. "Fracture of Ti—Al3Ti metal-intermetallic laminate composites: Effects of lamination on resistance-curve behavior", Metallurgical and Materials Transactions A, 2005, 36A, 10 pgs.
Demetriou, et al. "Glassy Steel Optimized for Glass-Forming ability and toughness", Applied Physics Letters 95, 041907, 10 pgs.
Roberts, "Developing and Characterizing Bulk Metallic Glasses for Extreme Applications", XP055731434, Retrieved from the Internet (Dec. 16, 2013): URL:https://thesis.library.caltech.edu/8049/141/Scott_Roberts_thesis_2013_Complete Thesis. pdf [retrieved on Sep. 17, 2020], 10 pgs.
Zh Eng et al. "Processing and Behavior of Fe-Based Metallic Glass Components via Laser-Engineered Net Shaping", Metallurginacal and Materials Transactions A, 40A, 1235-1245.
Cheung et al., "Thermal and mechanical properties of Cu—Zr—Al bulk metallic glasses", Journal of Alloys and Compounds 434-435 (2007) 71-74.
Davis, "Gear Materials, Properties, and Manufacture", ASM International 2005 Chapters 1-3 pp. 1-76.
Jiang et al., "Microstructure evolution and mechanical properties of Cu46Zr47Al7 bulk metallic glass composite containing CuZr crystallizing phases", Materials Science and Engineering A 467 (2007) 139-145.
Yokoyama et al., "Relations between the Thermal and Mechanical Properties of Cast Zr—Tm—Al (TM: Cu, Ni, or Co) Bulk Glassy Alloys", Materials. Transactions, vol. 48, No. 7 (2007) pp. 1846-1849.

* cited by examiner

SYSTEMS AND METHODS FOR SHAPING SHEET MATERIALS THAT INCLUDE METALLIC GLASS-BASED MATERIALS

CROSS-REFERENCE TO RELATED APPLICATIONS

The current application is a divisional of U.S. application Ser. No. 14/252,585, filed Apr. 14, 2014, which application claims priority to U.S. Provisional Application No. 61/811,405, filed Apr. 12, 2013, the disclosures of which are incorporated herein by reference in their entirety.

STATEMENT OF FEDERAL FUNDING

The invention described herein was made in the performance of work under a NASA contract, and is subject to the provisions of Public Law 96-517 (35 U.S.C. 202) in which the Contractor has elected to retain title.

FIELD OF THE INVENTION

The present invention generally relates to shaping metallic glass-based sheet material.

BACKGROUND

Metallic glasses, also known as amorphous alloys, embody a relatively new class of materials that is receiving much interest from the engineering and design communities. Metallic glasses are characterized by their disordered atomic-scale structure in spite of their metallic constituent elements—i.e. whereas conventional metallic materials typically possess a highly ordered atomic structure, metallic glass materials are characterized by their disordered atomic structure. Notably, metallic glasses typically possess a number of useful material properties that can allow them to be implemented as highly effective engineering materials. For example, metallic glasses are generally much harder than conventional metals, and are generally tougher than ceramic materials. They are also relatively corrosion resistant, and, unlike conventional glass, they can have good electrical conductivity. Importantly, the manufacture of metallic glass materials lends itself to relatively easy processing in certain respects. For example, the manufacture of a metallic glass can be compatible with an injection molding process.

Nonetheless, the manufacture of metallic glasses presents challenges that limit their viability as engineering materials. In particular, metallic glasses are typically formed by raising a metallic alloy above its melting temperature, and rapidly cooling the melt to solidify it in a way such that its crystallization is avoided, thereby forming the metallic glass. The first metallic glasses required extraordinary cooling rates, e.g. on the order of $10^6$ K/s, and were thereby limited in the thickness with which they could be formed. Indeed, because of this limitation in thickness, metallic glasses were initially limited to applications that involved coatings. Since then, however, particular alloy compositions that are more resistant to crystallization have been developed, which can thereby form metallic glasses at much lower cooling rates, and can therefore be made to be much thicker (e.g. greater than 1 mm). These metallic glass compositions that can be made to be thicker are known as 'bulk metallic glasses' ("BMGs").

In addition to the development of BMGs, 'bulk metallic glass matrix composites' (BMGMCs) have also been developed. BMGMCs are characterized in that they possess the amorphous structure of BMGs, but they also include crystalline phases of material within the matrix of amorphous structure. For example, the crystalline phases can exist in the form of dendrites. The crystalline phase inclusions can impart a host of favorable materials properties on the bulk material. For example, the crystalline phases can allow the material to have enhanced ductility, compared to where the material is entirely constituted of the amorphous structure. BMGs and BMGMCs can be referred to collectively as BMG-based materials. Similarly, metallic glasses, metallic glasses that include crystalline phases of material, BMGs, and BMGMCs can be referred to collectively as metallic glass-based materials or MG-based materials.

Although considerable advances have been made in the development of MG-based materials, they have yet to be developed to an extent where they can truly be implemented as viable, widespread engineering materials. Recently, efforts have been made to develop MG-based feedstock that is in the form of conventional sheet metal, e.g. a sheet of material having a thickness of between approximately 0.1 mm and approximately 10 mm, and being substantially planar otherwise. It is believed that such 'MG-based sheet materials' can lend themselves to conventional manufacturing processes, and thereby facilitate the widespread implementation of MG-based materials.

SUMMARY OF THE INVENTION

Systems and methods in accordance with embodiments of the invention advantageously shape sheet materials that include metallic glass-based materials. In one embodiment, a method of shaping a sheet of material including a metallic glass-based material includes: heating a metallic glass-based material within a first region within a sheet of material to a temperature greater than the glass transition temperature of the metallic glass-based material; where the sheet of material has a thickness of between approximately 0.1 mm and approximately 10 mm; where at least some portion of the sheet of material does not include metallic glass-based material that is heated above its respective glass transition temperature when the metallic glass-based material within the first region is heated above its respective glass transition temperature; and deforming the metallic glass-based material within the first region while the temperature of the metallic glass-based material within the first region is greater than its respective glass transition temperature.

In another embodiment, the sheet of material has a thickness of between approximately 0.1 mm and approximately 3 mm.

In still another embodiment, the temperature of the metallic glass-based material within the first region is maintained below its crystallization temperature when it is heated above the glass transition temperature.

In yet another embodiment, at least a majority of the sheet of material, as measured by volume, does not include metallic glass-based material that is heated above its respective glass transition temperature when the metallic glass-based material within the first region is heated above its respective glass transition temperature.

In still yet another embodiment, heating the metallic glass-based material within the first region is accomplished using one of: induction heating, frictional heating, and a heated fluid.

In a further embodiment, deforming the metallic glass-based material within the first region is accomplished by pressing a shaping tool into the sheet of material.

In a still further embodiment, a method of shaping a sheet of material including a metallic glass-based material includes: subjecting a sheet of material including a metallic glass-based material to direct contact with a heated fluid so as to raise the temperature of at least some portion of the metallic glass-based material to a temperature that is above its glass transition temperature; where the sheet of material has a thickness between approximately 0.1 mm and 10 mm; and deforming the metallic glass-based material that has been heated by the heated fluid to a temperature above its glass transition temperature.

In a yet further embodiment, the sheet of material is between approximately 0.1 mm and 3 mm.

In a still yet further embodiment, the metallic glass-based material that is heated above its glass transition temperature because of the heated fluid is maintained at a temperature lower than its crystallization temperature.

In another embodiment, deforming the metallic glass-based material that has been heated by the heated fluid is accomplished by using the heated fluid to deform the sheet of material.

In yet another embodiment, deforming the metallic glass-based material that has been heated by the heated fluid is accomplished by pressing a shaping tool into the sheet of material as it is supported, at least in part, by the heated fluid.

In still another embodiment, a method of shaping a sheet of material including a metallic glass-based material includes: moving a surface relative to a sheet of material including a metallic glass-based material while the surface and the sheet of material are in direct contact so as to frictionally heat the metallic glass-based material within the sheet of material above its glass transition temperature; where the sheet of material has a thickness of between approximately 0.1 mm and approximately 10 mm; deforming the metallic glass-based material that has been heated by the frictional heating to a temperature above its glass transition temperature.

In still yet another embodiment, the sheet of material has a thickness of between approximately 0.1 mm and approximately 3 mm.

In a further embodiment, the metallic glass-based material that has been heated by the frictional heating is maintained at a temperature lower than its crystallization temperature during the frictional heating.

In a still further embodiment, moving the surface relative to the sheet of material includes rotating the surface relative to the sheet of material so as to frictionally heat it.

In a yet further embodiment, deforming the metallic glass-based material is accomplished by pressing the surface into the sheet of material.

In a still yet further embodiment, deforming the metallic glass-based material is accomplished by pressing the surface into the sheet of material so that it conforms to the shape of a mold cavity.

In another embodiment, deforming the metallic glass-based material is accomplished by using pressurized gas.

In still another embodiment, a method of shaping a sheet of material including a metallic glass-based material includes: deforming a metallic glass-based material within a sheet of material at a temperature lower than the glass transition temperature of the metallic glass-based material, the metallic glass-based material having a volume fraction of crystalline phase greater than approximately 30% and a fracture toughness greater than approximately 80 $MPa \cdot m^{1/2}$; where the sheet of material has a thickness of between approximately 0.1 mm and approximately 10 mm.

In yet another embodiment, the metallic glass-based material has a volume fraction of crystalline phase of greater than approximately 40% and a fracture toughness greater than approximately 100 $MPa \cdot m^{1/2}$.

In still yet another embodiment, the sheet of material has a thickness that is less than approximately three times the size of the plastic zone radius of the metallic glass-based material.

In a further embodiment, the sheet of material has a thickness that is less than approximately one-third the size of the plastic zone radius of the metallic glass-based material.

In a still further embodiment, the sheet of material has a thickness of between approximately 0.1 mm and approximately 3 mm.

In a yet further embodiment, deforming the metallic glass-based material is accomplished using a pressing tool.

In a still yet further embodiment, the method further includes removing portions of the sheet of material in a periodic fashion; and deforming the sheet of material that no longer includes the removed portions so as to form a cellular structure.

In another embodiment, deforming the sheet of material is accomplished using a punch and die.

In still another embodiment, the metallic glass-based material is $Zr_{55.3}Ti_{24.9}Nb_{10.8}Cu_{6.2}Be_{2.8}$.

In yet another embodiment, a cellular structure includes a metallic glass-based material having a volume fraction of crystalline phase greater than approximately 30% and a fracture toughness greater than approximately 80 $MPa \cdot m^{1/2}$.

In still yet another embodiment, the metallic glass-based material has a volume fraction of crystalline phase greater than approximately 40% and a fracture toughness greater than approximately 100 $MPa \cdot m^{1/2}$.

In a further embodiment, the metallic glass-based material is $Zr_{55.3}Ti_{24.9}Nb_{10.8}Cu_{6.2}Be_{2.8}$.

DETAILED DESCRIPTION

Figure 1:
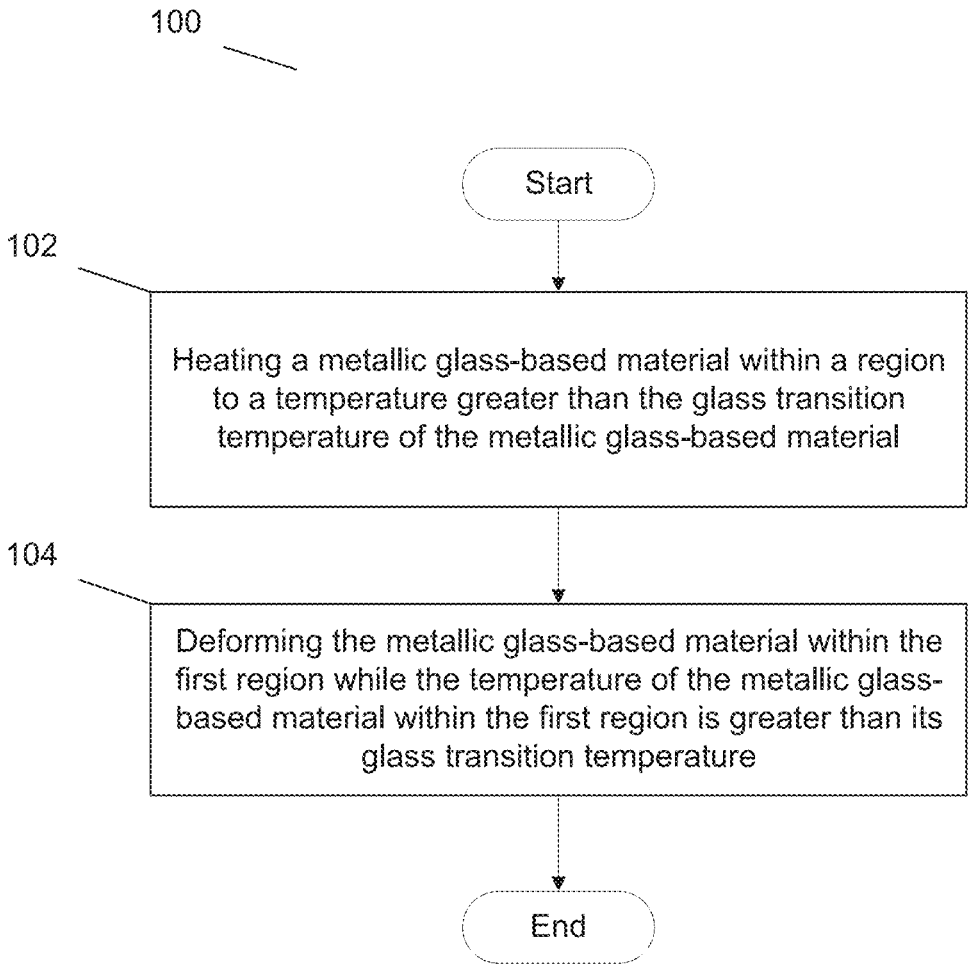
FIG. 1 illustrates a method of shaping a sheet material including a metallic glass-based material by instituting localized thermoplastic deformation in accordance with an embodiment of the invention.

Turning now to the drawings, systems and methods for advantageously shaping sheet materials that include metallic glass-based materials are illustrated. In many embodiments, a method of shaping a sheet of material that includes a metallic glass-based material includes locally heating a region of the sheet of material, the region including a metallic glass based-material, such that the temperature of the metallic glass based-material that is within the region is elevated to above its glass transition temperature, and deforming the heated metallic glass-based material into a desired configuration. In numerous embodiments, the sheet of material has a thickness of between approximately 0.1 mm and 10 mm. In many embodiments, a method of shaping a sheet of material that includes a metallic glass-based material includes subjecting the sheet of material to direct contact with a heated fluid so as to raise the temperature of at least some portion of the metallic glass-based material to a temperature above its glass transition temperature, and deforming the metallic glass-based material while it is heated above its glass transition temperature. In numerous embodiments, a method of shaping a sheet of material that includes a metallic glass-based material includes moving a surface relative to the sheet of material while the surface and the sheet of material are in direct contact so as to frictionally heat the metallic glass-based material to a temperature above its glass transition temperature, and deforming the metallic glass-based material that has been heated by the frictional heating to a temperature above its glass transition temperature.

The efforts to develop metallic glass-based materials so that they can more viably be incorporated as engineering and/or design materials has led to the development of metallic glass-based materials in the form of conventional sheet metal. It is believed that metallic glass-based materials in this form factor can more easily lend themselves to conventional shaping processes, and can thereby promote their practicality. For example, metallic glass-based materials in the shape of conventional sheet metal can act as feedstock for subsequent shaping processes, e.g. those commonly used to form conventional metallic components. As one example, Prest et al. disclose a method for forming amorphous alloy sheets including pouring molten metal so that it forms a sheet, floating the sheet of molten metal on a second molten metal, cooling the sheet of molten metal to form a metallic glass, and annealing the sheet without deteriorating its metallic glass qualities in U.S. Pat. No. 8,485,245. The disclosure of U.S. Pat. No. 8,485,245 is hereby incorporated by reference in its entirety.

Although sheets of metallic glass-based material have been formed, they are typically still not entirely compatible with conventional shaping processes. For example, while metallic glasses may be relatively tough compared to conventional glasses, they may not be tough enough to withstand a conventional folding operation, e.g. one that a conventional metal may be able to withstand. In essence, sheets of metallic glass-based are not universally compatible with conventional forming/shaping operations. Instead, methods for forming a metallic glass-based sheet material typically involve heating the sheet so that it may be thermoplastically formed/shaped. For example, in U.S. Pat. No. 8,613,815, Johnson et al. disclose using a rapid capacitor discharge to heat an amorphous alloy sample above its glass transition temperature and simultaneously thermoplastically forming/shaping the sample. The disclosure of U.S. Pat. No. 8,613,815 is hereby incorporated by reference in its entirety. However, it is not clear that using a rapid capacitor discharge can be effective for example to heat a sheet of material based on a bulk metallic glass matrix composite that includes crystalline phases beyond some threshold extent. Instead, the crystalline inclusions may inhibit the heating effect of the rapid capacitive discharge.

Additionally, Jan Schroers et al. have disclosed the thermoplastic blow molding of metallic glass sheet materials to form/shape them; these techniques essentially regard the heating of the metallic glass sheet above the glass transition temperature, and thereafter shaping them using conventional blow molding techniques. Nonetheless, the techniques presently known for shaping metallic glass-based sheet materials may not be inefficient and non-optimal in a variety of circumstances. Accordingly, the instant application discloses further methods that can more efficiently shape metallic glass sheet material, and can thereby make metallic glass-based material an even more viable option as an engineering material.

For example, in some embodiments, metallic glass-based sheet material is heated only where deformation is to occur (as opposed to the entire metallic glass-based sheet material being heated). In this way, the risk of adversely impacting the material properties of the sheet material with unnecessary heating can be mitigated. In a number of embodiments, a heated hydraulic fluid is used to heat a metallic glass-based sheet material above its glass transition temperature; the hydraulic fluid can then be used in the shaping/forming of the metallic glass sheet material. Using heated hydraulic fluid in the shaping of metallic glass sheet material can be an effective shaping method insofar as the fluid can provide substantial pressure to the metallic glass sheet material and cause it to conform to unique mold cavity geometries that may be difficult to accomplish otherwise. In several embodiments, a metallic glass sheet material is frictionally heated to above its glass transition temperature; the tool causing the frictional heating may then be used to shape the metallic glass sheet material. In this way, cooling can be quickly initiated by removing the tool. Quickly initiating the cooling stage is important in maintaining the amorphous structure of the metallic glass-based material. In many embodiments, a method of shaping a metallic glass sheet material involves shaping the metallic glass-based sheet material at room temperature—this can be achieved when the metallic glass-based sheet material has the requisite materials properties. These processes are now discussed in greater detail below.

Shaping Processes Incorporating Localized Thermoplastic Deformation

In many embodiments, metallic glass-based sheet materials are shaped by heating only those regions of the sheet where thermoplastic deformation is to take place. In this way the unnecessary heating of the remainder of the sheet material can be avoided. Avoiding the unnecessary heating of the remainder of the sheet material can confer a number of benefits. For example, in general, heating metallic glass-based materials to a temperature where they can be thermoplastically formed (e.g. above their glass transition temperatures) carries with it the risk of inadvertently heating the metallic glass-based materials to a temperature above the crystallization temperature, thereby causing the metallic-glass based material to crystallize and lose its glass-like qualities. Moreover, heating metallic glass-based materials additionally carries the risk of causing unwanted oxidation. Accordingly, by avoiding unnecessarily heating the sheet material where heating is not required, the risk of adversely affecting the material properties is correspondingly reduced. Moreover, avoiding the unnecessary heating can allow the shaping process to be more energy efficient, e.g. energy is not needed to heat the entire sheet material—only those portions that embody the deformation.

FIG. 1 illustrates a process for shaping a metallic glass-based sheet material that includes locally heating and deforming the sheet material in accordance with embodiments of the invention. In particular, the process 100 includes heating 102 a metallic glass-based material that is within a region within a sheet of material to a temperature greater than the glass transition temperature of the metallic glass based material. Note that the sheet of material can be of any dimensions. As can be appreciated, sheet materials are typically substantially planar and have a characteristic thickness. The characteristic thickness can be of any suitable dimensions. In many embodiments, sheets having a thickness of between approximately 0.1 mm and approximately 10 mm are implemented in the process. In numerous embodiments, sheets having a thickness of between approximately 0.1 mm and 3 mm are implemented. Notably, in many embodiments, the sheet of material is entirely constituted of a single metallic glass-based material. In a number of embodiments, the sheet of material is constituted of a first metallic glass-based material and at least a second metallic glass-based material. In several embodiments, the sheet of material is constituted of a metallic glass-based material in conjunction with another material. Generally, any suitable sheet of material that includes a metallic-glass based material can be implemented in accordance with embodiments of the invention.

Additionally, the metallic glass-based material within a region can be heated 102 using any suitable technique in accordance with embodiments of the invention. For example, in many embodiments, the metallic glass-based material within the region is heated using induction heating. In a number of embodiments, the metallic glass-based material within the region is heated using a heated fluid. In many embodiments, the metallic glass-based material is heated frictionally. In general, any suitable method of heating the metallic glass-based material within the region can be implemented.

In numerous embodiments, at least some portion of the sheet material is maintained at a temperature lower than the glass transition temperature of the heated metallic-glass based material. In several embodiments, at least some of the metallic glass-based material within the sheet of material is at a temperature lower than its respective glass transition temperature when the metallic glass-based material within the region is heated above its respective glass transition temperature. In many embodiments, at least some portion of the sheet material is maintained at a lower temperature than the lowest glass transition temperature amongst any of the metallic glass-based materials that are present in the sheet of material. In a number of embodiments, the majority of the sheet material (e.g. as measured by volume, or alternatively, by surface area) does not include metallic glass-based material that is above its respective glass transition temperature when the metallic glass-based material within the region is heated to above its glass transition temperature. In several embodiments, the majority of the sheet of material is maintained at a temperature lower than the lowest glass transition temperature of any of the metallic glass-based materials that are present in the sheet of material. In many embodiments, the temperature of the metallic glass-based material is kept below the crystallization temperature.

Figure 2:
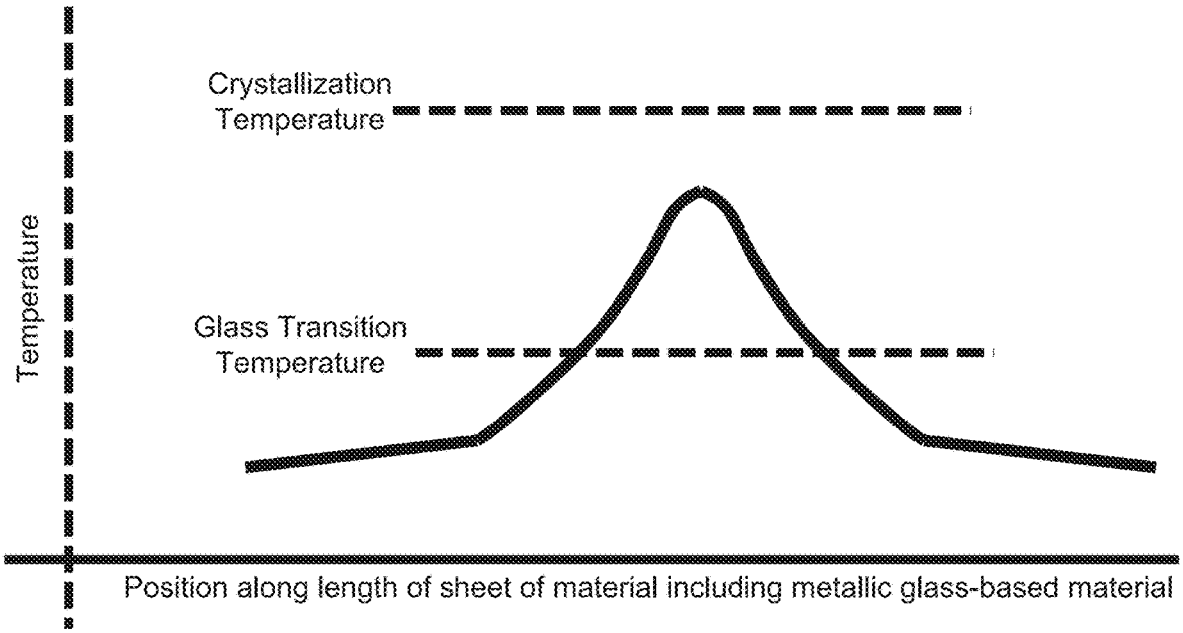
FIG. 2 illustrates the temperature profile of a sheet of material including a metallic glass-based material when the sheet of material is subjected to localized heating in accordance with an embodiment of the invention.

FIG. 2 depicts a schematic illustration of the temperature as a function of location along a length of a sheet of material that is entirely constituted of a single metallic glass-based material. In particular, it is illustrated that only a certain region of the sheet of material is heated above the glass transition temperature of the metallic glass-based material. Thus, as can be appreciated, this region of the sheet can be thermoplastically formed, whereas the other portions are not amenable to thermoplastic forming.

Returning back to FIG. 1, the method 100 further includes deforming 104 the metallic glass based-material within the region while it has been heated 102 above the glass transition temperature of the metallic glass-based material. In other words, the method 100 involves thermoplastically forming the sheet of material. The metallic glass based material can be deformed 104 in any suitable way in accordance with embodiments of the invention. For example, the metallic glass-based material can be folded, stamped, corrugated, etc. In general, any method of contorting the heated metallic glass-based material in the region can be implemented. Thus, using this method, metallic glass-based sheet material can be more efficiently shaped.

Figure 3A:
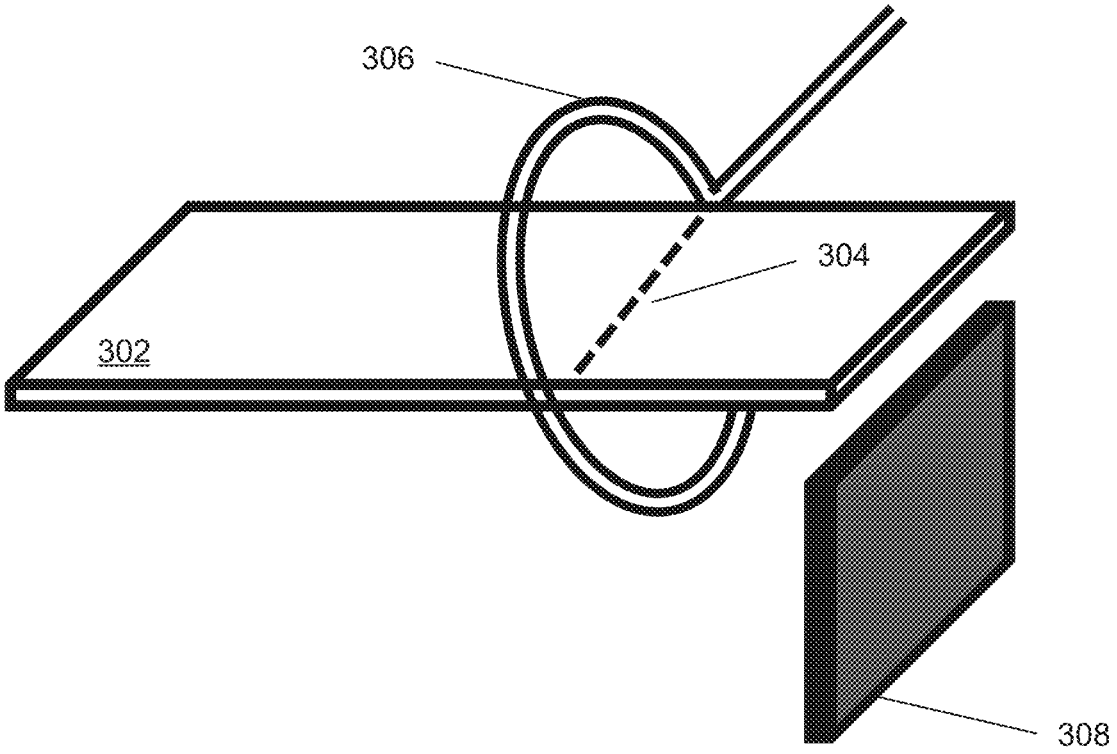
FIGS. 3A-3B depict shaping a sheet material including a metallic glass-based material by instituting localized thermoplastic deformation in accordance with an embodiment of the invention.
Figure 3B:
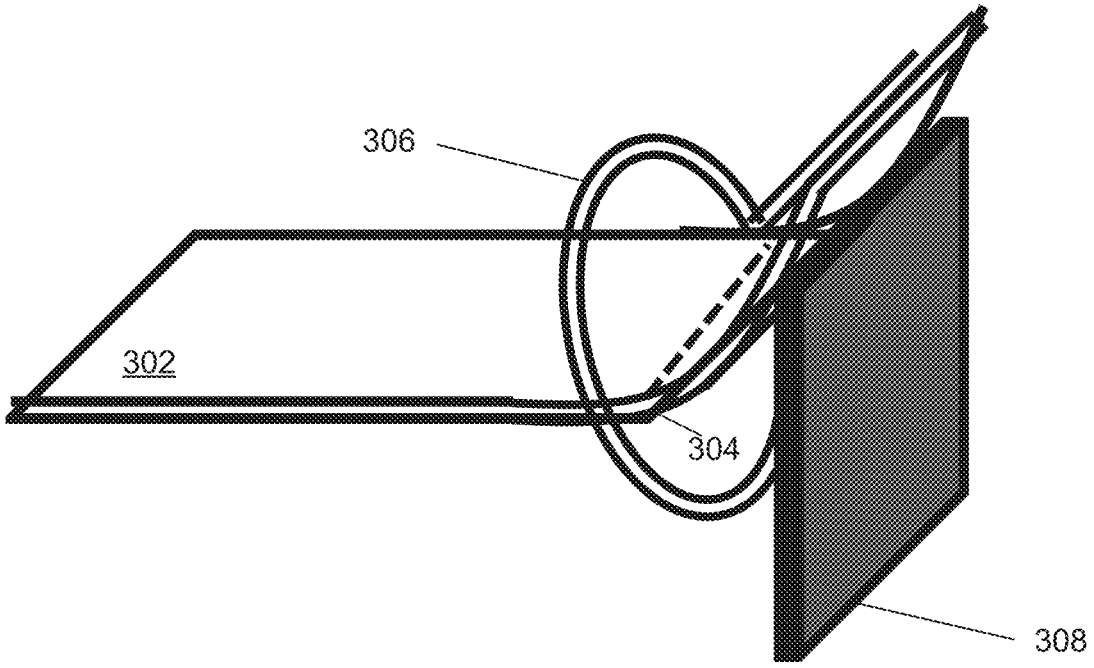

FIGS. 3A and 3B depict the local heating and deformation of a sheet material in accordance with embodiments of the invention. In particular, FIG. 3A depicts a sheet of material 302 including a first region 304, that itself includes a metallic glass-based material. The first region 304 is heated by an induction coil 306 so that the temperature of the residing metallic glass-based material is elevated to above its glass transition temperature. FIG. 3B depicts a tool 308 that is used to apply an upward force on the sheet of material 302 while the first region 304 is heated so as to cause the thermoplastic deformation of the metallic glass-based material in the region 304 in accordance with embodiments of the invention. Note that in the illustrated embodiment, the remainder of the sheet of material is not unnecessarily heated as it is not intended to be thermoplastically formed. Of course, as can be appreciated, while FIGS. 3A and 3B depict an induction coil heater, the metallic glass-based material within the region can be heated using any suitable technique in accordance with embodiments of the invention.

Figure 4A:
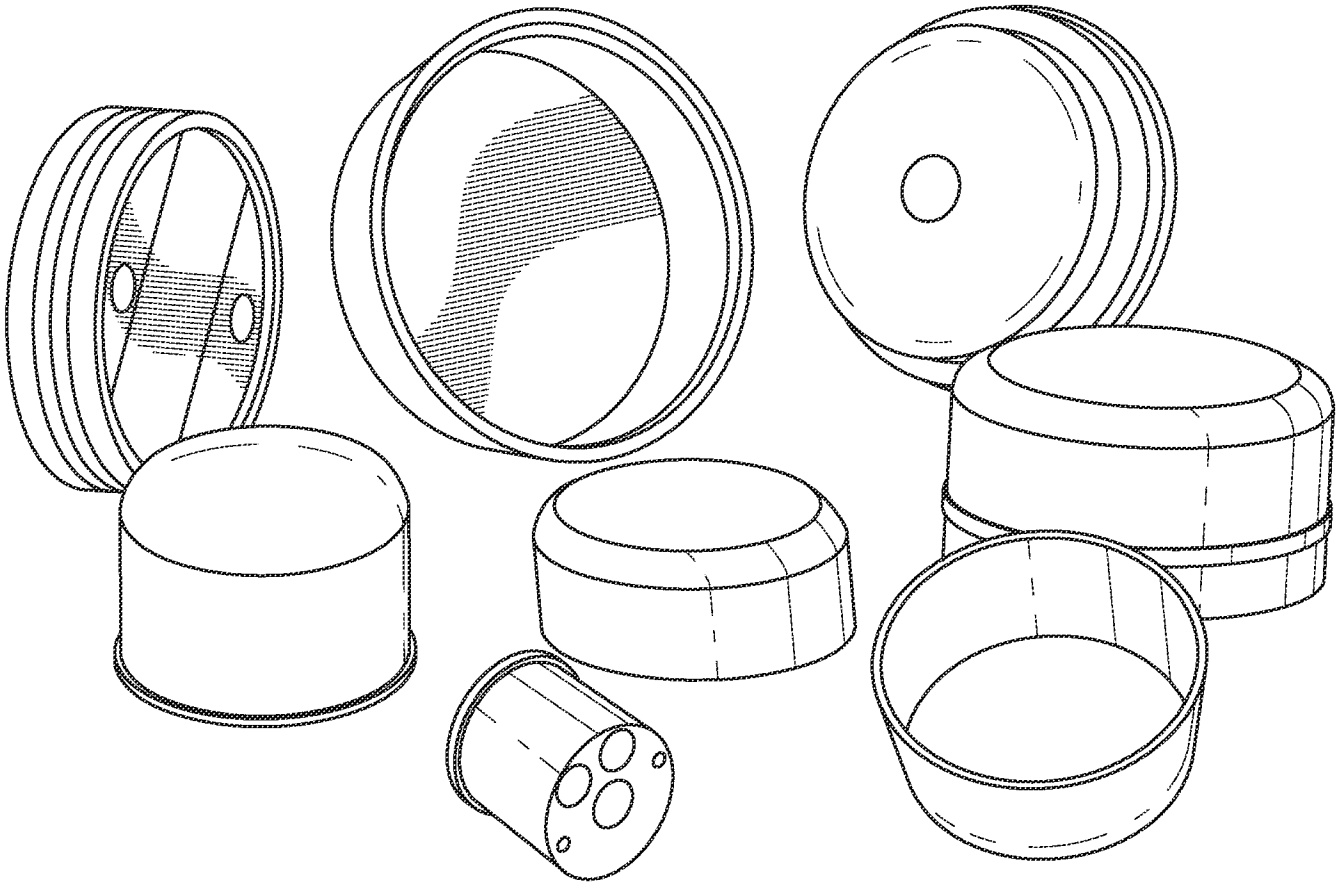
FIGS. 4A-4F illustrate shaping a sheet material including a metallic glass-based material into a pot-shaped structure by instituting localized thermoplastic deformation in accordance with an embodiment of the invention.
Figure 4B:
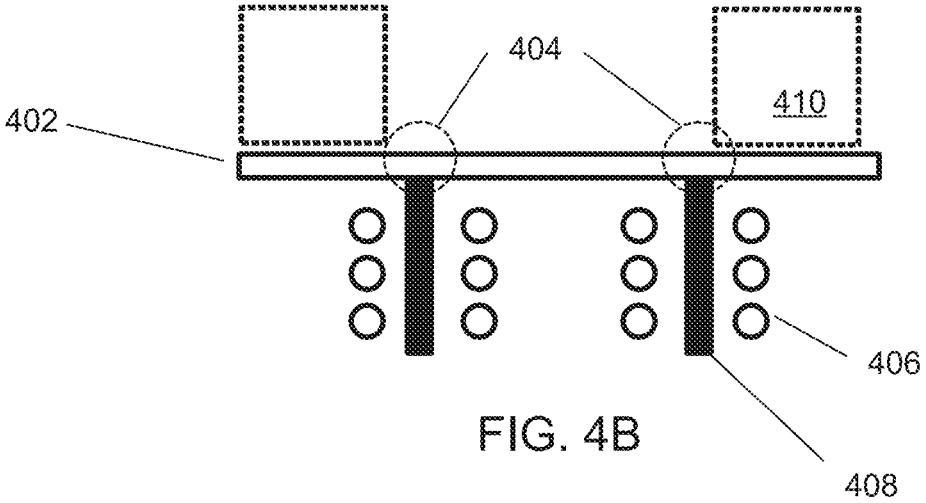
Figure 4C:
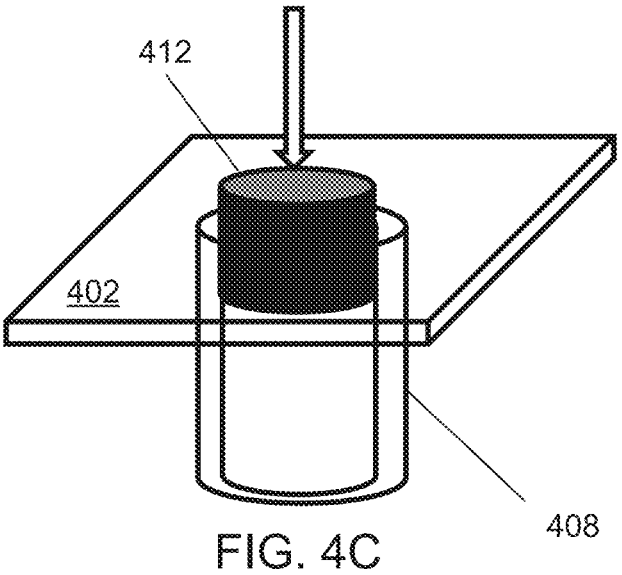

Although FIGS. 3A-3B depict the folding of a metallic glass-based sheet material, a sheet of material including metallic glass-based materials can be themoplastically formed in any suitable way in accordance with embodiments of the invention. For example, FIGS. 4A-4E illustrate that pot shaped structures can be formed from metallic glass-based sheet materials in accordance with embodiments of the invention. In particular, FIG. 4A depicts the general shape of pots, which can be characterized by a principal bend adjoining the bottom of the pot and its walls. FIG. 4B depicts the general setup that can be used to form a pot-shaped structure in accordance with embodiments of the invention. In particular, FIG. 4B depicts a metallic glass-based sheet material 402 being supported by a cylindrical structure 408 that is thermally conductive. The sheet of material 402 is also held in place by structure 410. Induction coils 406 are used to heat the thermally conductive cylindrical structural 408. Regions 404 are highlighted as the target areas for the thermoplastic deformation. The Induction coils 406 are used to heat the thermally conductive structure 408 so that the region 404 of the sheet of material 402 can be heated to above the glass transition temperature. Bear in mind that FIG. 4B illustrates a cross-sectional view of the set up—as can be appreciated, the illustration is meant to communicate circular geometries. For purposes of clarity, FIG. 4C depicts an isometric view of setup. The structure 410 and the induction coils 406 are omitted in FIG. 4C for purposes of clarity.

Figure 4D:
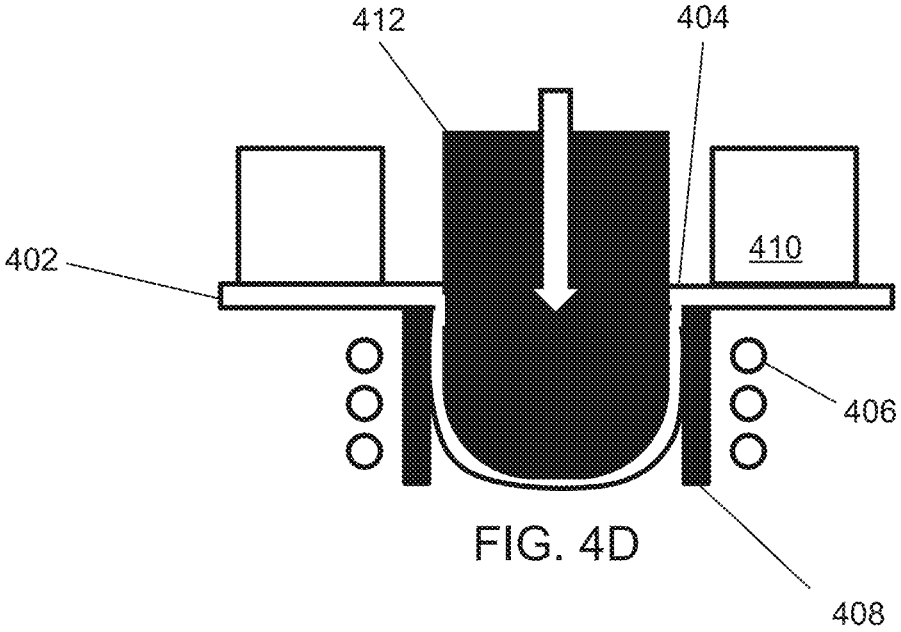

FIG. 4D depicts that a cylindrical tool 412 is used to shape the metallic glass based sheet material 402 while the region 404 has been has been heated so that its constituent metallic glass-based material is above its glass transition temperature. In particular, the cylindrical tool 412 is pressed into the sheet material to shape it. The heated region 404 can accommodate the thermoplastic shaping that can enable the creation of the structure.

Figure 4E:
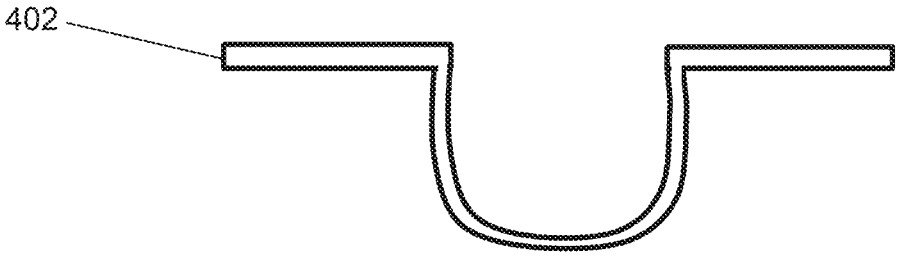
Figure 4F:
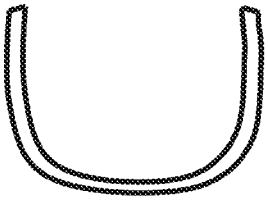

FIG. 4E depicts the shape of the sheet material 402 after it has been treated, and FIG. 4F depicts that the remainder of the sheet material may be separated from the pot-shaped structure.

Figure 5A:
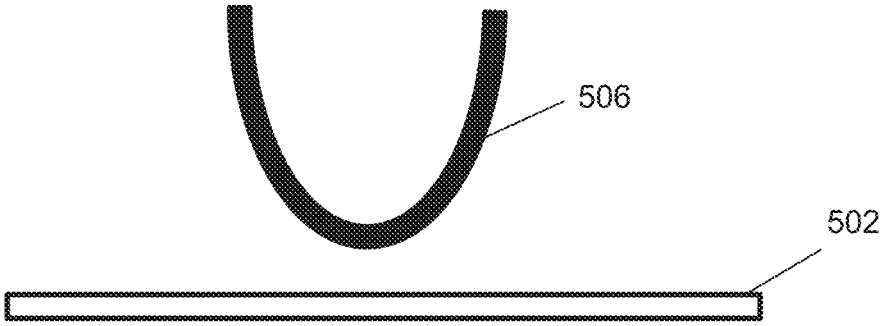
FIGS. 5A-5C illustrate using a heated shaping tool to implement localized thermoplastic deformation in accordance with an embodiment of the invention.
Figure 5B:
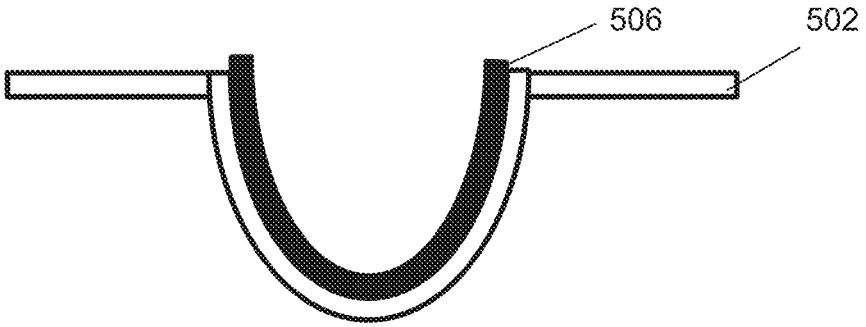
Figure 5C:
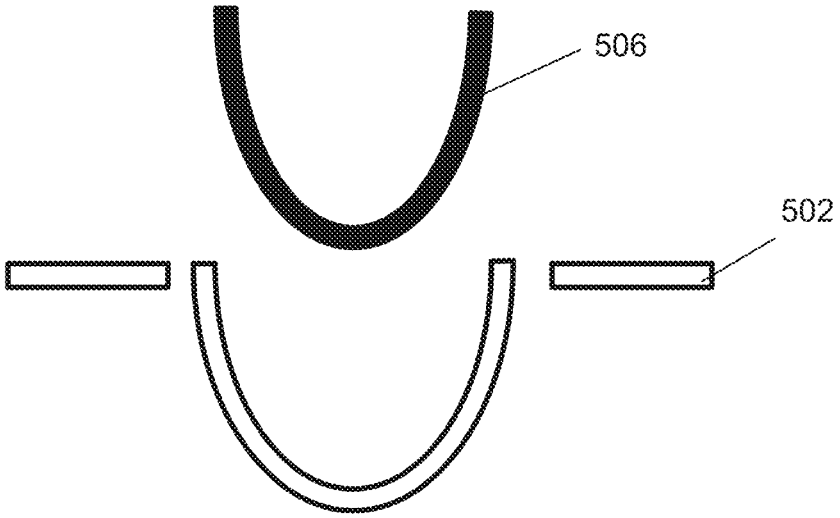

In some embodiments, the tool that is used to heat metallic glass-based material within a sheet is also used to shape the sheet material. FIGS. 5A-5C illustrate a method of shaping metallic glass-based sheet material, whereby a tool in the shape of a parabolic head is used to both heat the metallic glass-based material within a sheet to above its glass transition temperature and shape metallic glass-based sheet material. In particular, FIG. 5A depicts the metallic glass-based sheet material 502 along with a parabola-shaped tool 506 that is used to shape the metallic glass-based sheet material. The tool 506 is also used to heat a region of the sheet of material to a temperature above the glass transition temperature of its constituent metallic glass-based material. For example, the tool 506 itself can be heated, and thereby heat the sheet of material through conduction. Alternatively, the parabola-shaped tool 506 can be spun about its central axis against the sheet of material to generate frictional heating, and thereby heat the metallic glass-based sheet material 502 to the requisite temperature. FIG. 5B depicts that the tool 506 has been used to thermoplastically shape the sheet of material 502 as it has been heated above the requisite glass transition temperature. Note that the tool 506 is not in direct contact with any other portion of the sheet of material so that the remaining portions of the sheets of material are not necessarily heated above the aforementioned glass transition temperature. FIG. 5C depicts that, as before, the desired shape can be separated from the sheet material 502.

Figure 6A:
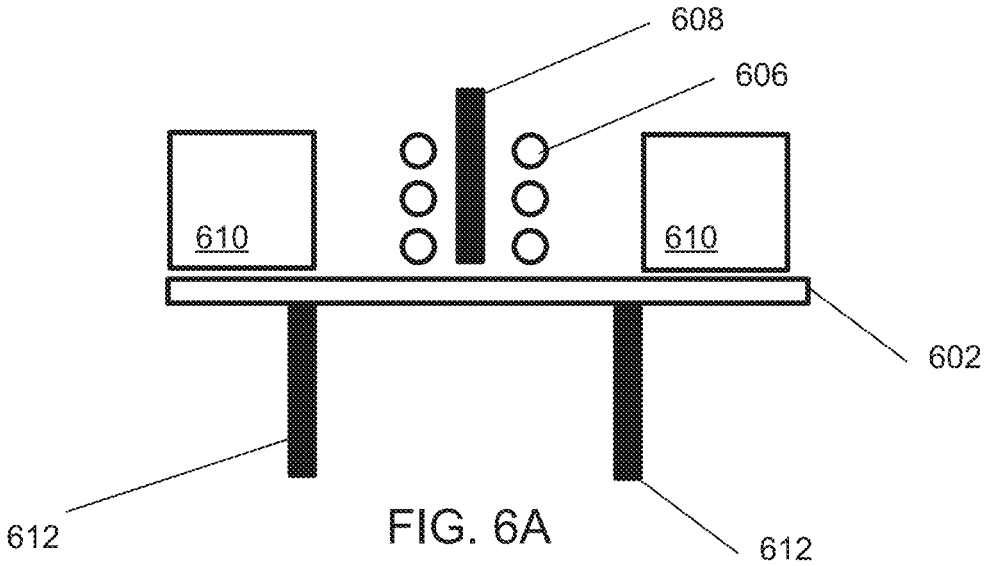
FIGS. 6A-6B illustrate using a line contact heater to implement localized thermoplastic deformation in accordance with an embodiment of the invention.
Figure 6B:
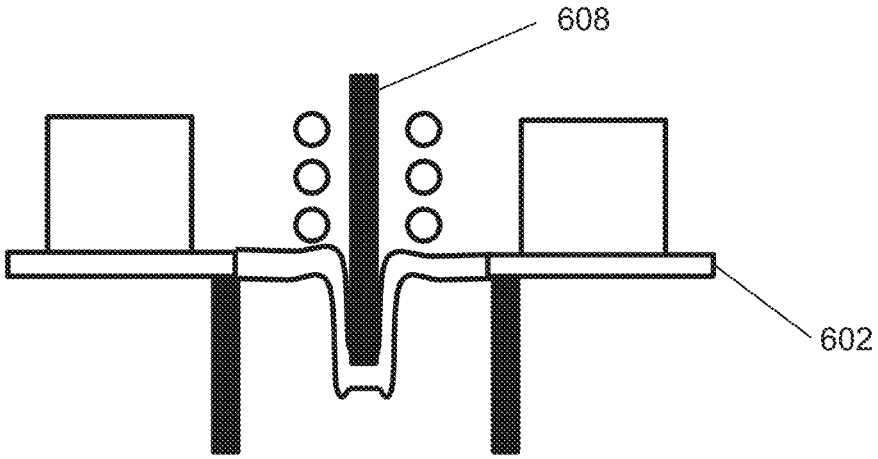

While the above illustrations depict that a cylindrical tool having a relatively large diameter is used to shape the metallic glass-based sheet material, it should be clear that a tool of any shape can be used to shape the sheet material object. For example, in some embodiments a line contact heater is used to heat and thermoplastically shape the sheet material. FIGS. 6A-6B depict shaping a sheet material with a line contact heater in accordance with embodiments of the invention. In particular, FIG. 6A depicts a sheet of material 602 supported by structures 610, 612. A line contact heater 608 is the tool that is used to form the sheet of material 602. The line contact heater is heated with induction coils 606. FIG. 6B depicts the shaping of the sheet of material 602 using the line contact heater 608. Note that the final shape of the shaped sheet metal will depend on a variety of parameters including: to what extent the metallic glass-based material was heated above its glass transition temperature, the force with which the line contact heater is applied to the sheet material, and the length of time that the sheet material is exposed to the line contact heater. As can be appreciated, any of these parameters can be varied to control the final shape of the sheet material.

The localized thermoplastic shaping techniques described above can be implemented and modified in any of a variety of ways in accordance with embodiments of the invention. For example, any of a variety of shaping tools can be used to shape heated metallic glass-based sheet materials. In some embodiments, a plurality of regions within a sheet of material including metallic glass-based materials are simultaneously thermoplastically shaped. It should also be appreciated that the sheet of material can include any suitable metallic glass-based material in accordance with embodiments of the invention, and is not limited to a particular subset of metallic glass-based materials. Generally, any of a variety of modifications to the above described techniques can be implemented in accordance with embodiments of the invention. Additionally, while the above discussion has focused on advantageously shaping sheet material including metallic glass-based materials using localized thermoplastic forming techniques, in many embodiments, fluids are used to thermoplastically form a sheet of material including metallic glass-based materials. These processes are now described in greater detail below.

Using Fluids in the Thermoplastic Shaping of Sheet Materials

In many embodiments, fluids are used to thermoplastically shape a sheet of material that includes a metallic glass-based material. In a number of embodiments, heated fluids are used to elevate the temperature of the constituent metallic glass-based material to above its respective glass transition temperature. Any fluid capable of heating a sheet of material including metallic glass-based material above the glass transition temperature of the metallic glass-based material can be utilized in accordance with embodiments of the invention. For example, in some embodiments, molten metal is used as the heating fluid. In a numerous embodiments, a conventional hydraulic fluid is used. In several embodiments, a heating oil is used. In a number of embodiments, a heating gas is used. In general, any suitable fluid that can heat a sheet of material including metallic glass-based materials can be utilized in accordance with embodiments of the invention. In many instances, it is simply required that the fluid be able to heat the sheet material to a temperature that is greater than approximately 350° C. The heated fluid can thereafter be used to apply pressure to the sheet of material and thereby cause it to conform to the shape of a tool. Using fluids in this manner can be advantageous insofar as fluids can more uniformly apply heat and pressure to a sheet of material against a tool irrespective of the tool geometry. For example, where a sheet of material is to be shaped by a curved tool, the liquid can more easily cause it to uniformly conform to the shape of the curvature. In general, the fluid can be used in conjunction with any shaping tool to shape the sheet of material in accordance with embodiments of the invention.

Figure 7:
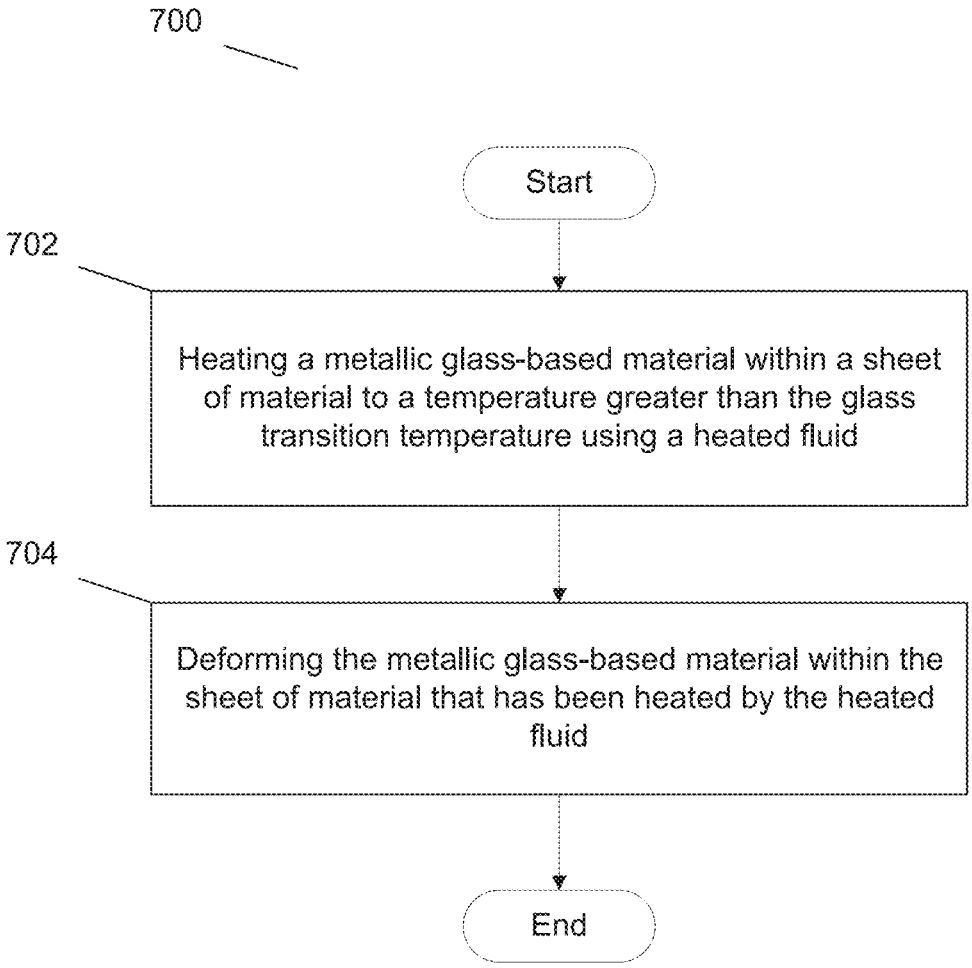
FIG. 7 illustrates a method of shaping a sheet material including a metallic glass-based material by using a heated fluid to heat the metallic glass-based material in accordance with an embodiment of the invention.

FIG. 7 depicts one method of shaping a sheet of material including a metallic glass-based material using a heated fluid in accordance with embodiments of the invention. In particular the method 700 includes heating 702 metallic glass-based material within a sheet of material using a fluid to a temperature greater than the glass transition temperature of the metallic glass-based material. As alluded to above, any suitable heating fluid can be implemented. The method 700 further includes deforming 704 the metallic glass-based material that has been heated by the heated fluid. Again, as previously alluded to, the deformation 704 can be achieved using any suitable technique.

Figure 8A:
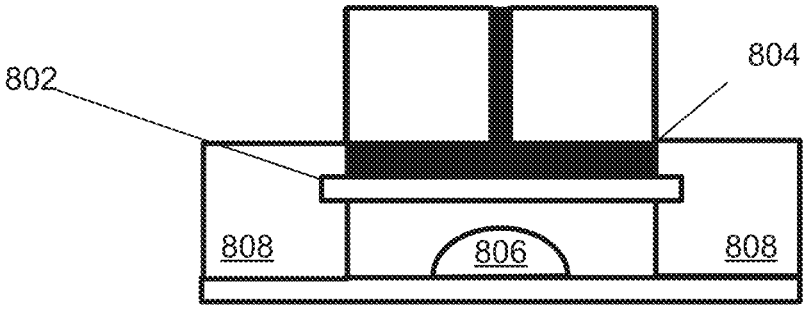
FIGS. 8A-8C illustrate using a heated fluid to shape a sheet of material including a metallic glass-based material in accordance with an embodiment of the invention.
Figure 8B:
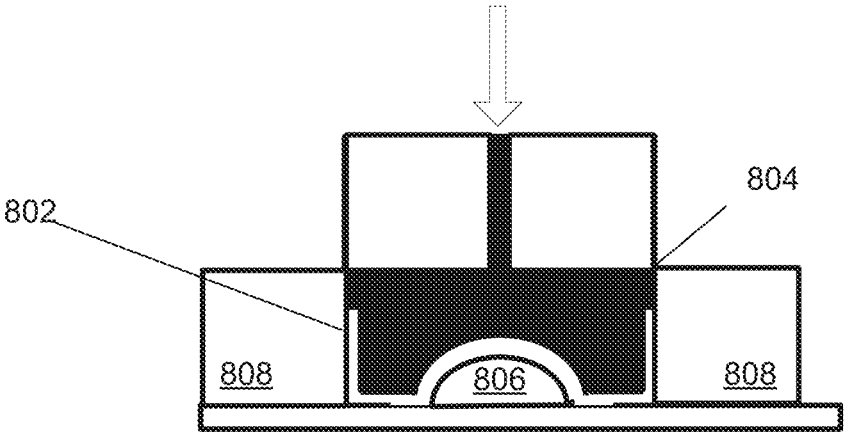
Figure 8C:
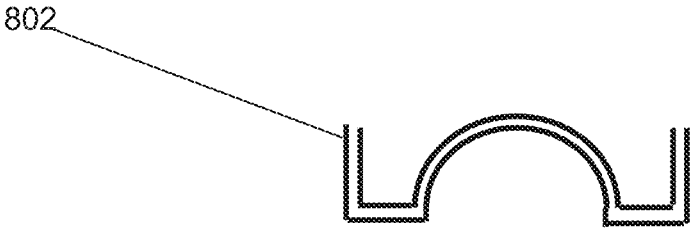

For example, in some embodiments, a shaping tool having a semi-circular cross section is used to shape a sheet of material including a metallic glass-based material in accordance with embodiments of the invention. FIGS. 8A-8C depict how such a heated fluid can be used in conjunction with such a shaping tool to shape a metallic glass-based sheet material in accordance with embodiments of the invention. In particular, FIG. 8A illustrates an initial setup that includes a sheet of material 802 including a metallic glass-based material, a fluid 804 that heats the sheet of material 802 to above the glass transition temperature of the constituent metallic glass-based material so that it can be thermoplastically shaped, and a mold 806 which shapes the sheet of material 802. The sheet of material 802 is held in place by supporting blocks 808. FIG. 8B depicts the thermoplastic shaping of sheet of material 802 by using the fluid 804 to apply sufficient pressure (e.g., 10,000 psi) to cause the sheet 802 to conform to the shape of the mold 806 after the temperature of the constituent metallic glass-based material is elevated to above its glass transition temperature. As alluded to above, the fluid can uniformly apply pressure to the sheet against the mold 806, and thereby more precisely cause the formation of the desired shape. FIG. 8C depicts the shape of the sheet 802 after the process. As mentioned above, any suitable heating fluid can be used in accordance with this process. Additionally, although a mold having a semi-circular shape has been illustrated, it should clear that any shaping tool can be incorporated. Indeed, the interchangeability of the shaping tools is one of the advantages of the described process.

Figure 9A:
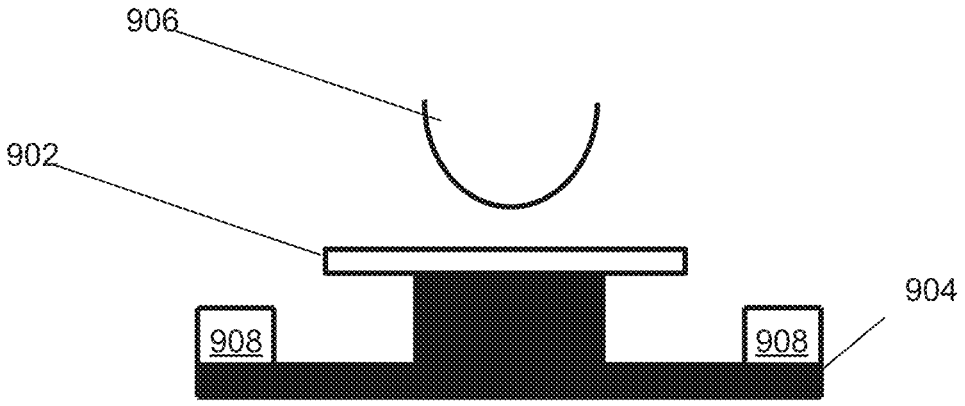
FIGS. 9A-9B illustrate shaping a sheet of material including a metallic glass-based material using a bed of heated fluid in accordance with an embodiment of the invention.
Figure 9B:
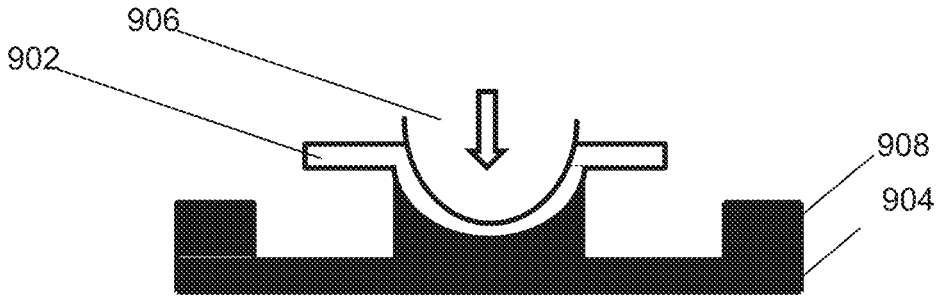

While FIGS. 8A-8C depict using a liquid to force a sheet of material against a shaping tool, in many embodiments a shaping tool is used to force a sheet of material against a heated fluid. For example, FIGS. 9A-9B depict shaping a sheet of material including metallic glass-based material by using a shaping tool to force the sheet of material against a bed of heated liquid in accordance with embodiments of the invention. In particular, FIG. 9A depicts an initial setup that includes a sheet of material 902 including metallic glass-based material disposed above a bed of heated fluid 904. The container housing the heated fluid includes reservoir regions 908. A shaping tool 906 is seen above the sheet of material 902. FIG. 9B depicts that she shaping tool 906 forces the sheet of material 902 into the bed of heated fluid 904 to shape it. As before, the heated fluid 904 can uniformly apply pressure to the sheet of material 902 against the shaping tool 906. As can be appreciated, the heated fluid elevates the temperature of the metallic glass-based material within the sheet of material 902 to above the glass transition temperature so that it can be thermoplastically formed. Notably, the reservoirs 908 accommodate the displaced fluid and thereby facilitate the shaping process. Thus, it is demonstrated how the heated fluid can support a sheet of material while it is being shaped by a distinct shaping tool.

Of course, it should be appreciated that the above-described processes can be varied in any of a variety of ways in accordance with embodiments of the invention. For example, as previously mentioned, any of a variety of fluids can be implemented, and the fluids do not necessarily have to be liquid—they can be gaseous. Similarly, any of a variety of shaping tools can be used in conjunction with the above-described processes. Additionally, in some embodiments, the fluid does not heat the sheet of material above the glass transition temperature of the constituent metallic glass-based material; instead the sheet of material is separately heated (e.g. using an induction heater), and the fluid is used to thermoplastically shape the separately heated material sheet. In a number of embodiments, the fluid is used in conjunction with another mechanism (e.g. an induction heater) to heat the sheet of material above the glass transition temperature of the constituent metallic glass-based material. The sheet of material can thereby be thermoplastically formed. Of course it should be appreciated that the above techniques can be applied in conjunction with any of a variety of suitable metallic glass-based materials—the process is not limited to a particular subset of metallic glass-based materials. While the above discussion has regarded using fluids in conjunction with the thermoplastic shaping of a sheet of material including a metallic glass-based material, in many embodiments, a sheet of material including metallic glass-based materials is heated frictionally above the relevant glass transition temperature so that it can be thermoplastically formed. These processes are now discussed in greater detail below.

Shaping Processes Incorporating Frictional Heating

In many embodiments of the invention, a sheet of material including metallic glass-based materials is heated frictionally so that they may be thermoplastically shaped. Incorporating frictional heating in thermoplastic shaping processes can be advantageous insofar as the subsequent cooling of the material can be initiated efficiently and virtually immediately with the removal of the friction-causing mechanism. Recall that cooling rates play a vital role in allowing a metallic glass-based material to retain its amorphous structure. Frictional heating can be instituted using any of a variety of processes in accordance with embodiments of the invention. For example, in many embodiments, a surface is rapidly rotated while in direct contact with a sheet of material including a metallic glass-based material so as to raise the temperature of the metallic glass based material above the relevant glass transition temperature. In a number of embodiments, frictional heating is effectuated by translational sliding of a surface with the material sheet. In many embodiments, the surface is the shaping tool that is used to thermoplastically shape the material sheet. In general, any mechanism for frictionally heating the sheet of material can be incorporated in accordance with embodiments of the invention.

Figure 10:
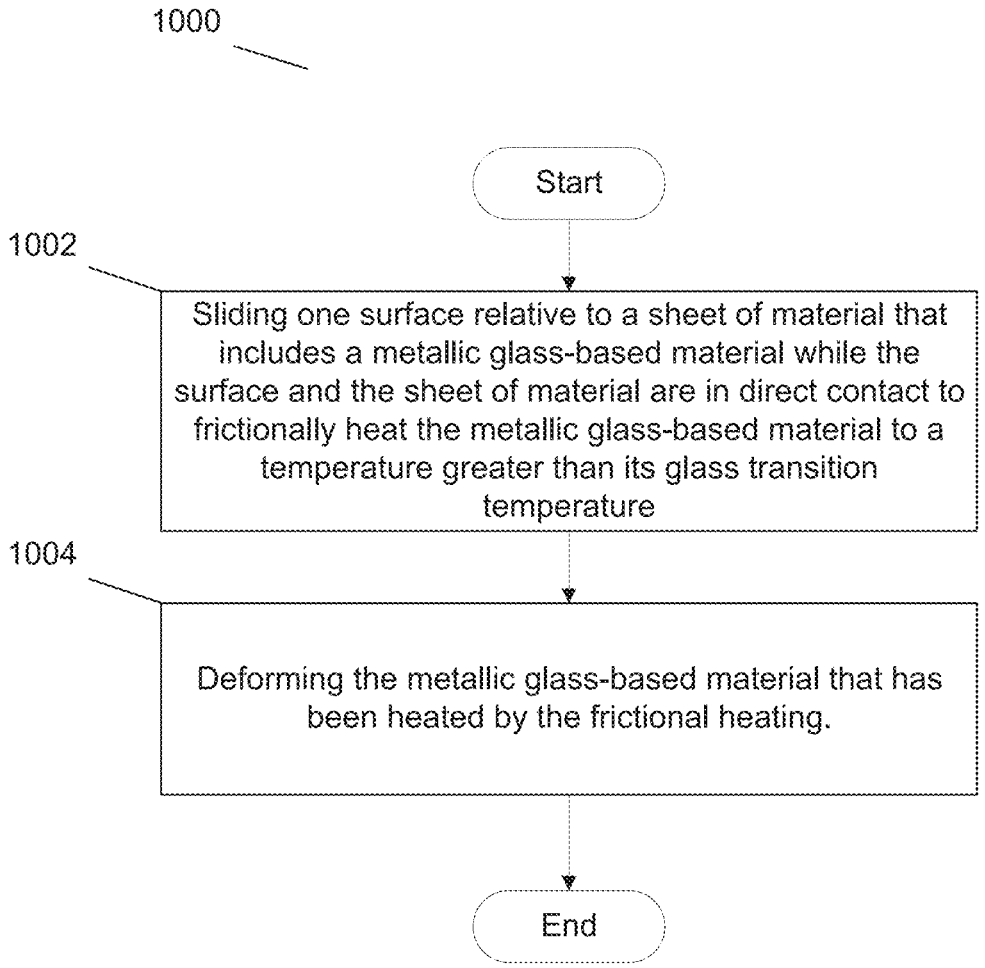
FIG. 10 illustrates a method of shaping a sheet material including a metallic glass-based material by using frictional heating to heat the metallic glass-based material in accordance with an embodiment of the invention.

FIG. 10 depicts one method of shaping a sheet of material including a metallic glass-based material by using frictional heating in accordance with embodiments of the invention. In particular, the method 1000 includes sliding 1002 a surface relative to a sheet of material that includes a metallic glass-based material while the surface and the sheet of material are in direct contact so as to frictionally heat the metallic glass-based material to a temperature above its glass transition temperature. As alluded to above, the relative motion can be achieved in any suitable way including by rotating the surface against the sheet of material and by translating the surface against the sheet of material. The method 1000 further includes deforming 1004 the metallic glass-based material that has been heated by the frictional heating. As can be appreciated, any method of deformation 1004 can be implemented. For example the surface that causes the friction can be pressed into the sheet of material. In some embodiments, a distinctly different surface (e.g. not the surface that causes friction) is used to cause the deformation. In a number of embodiments a gas is used to cause the deformation. In general, any suitable technique for causing the deformation can be implemented in accordance with embodiments of the invention.

Figure 11A:
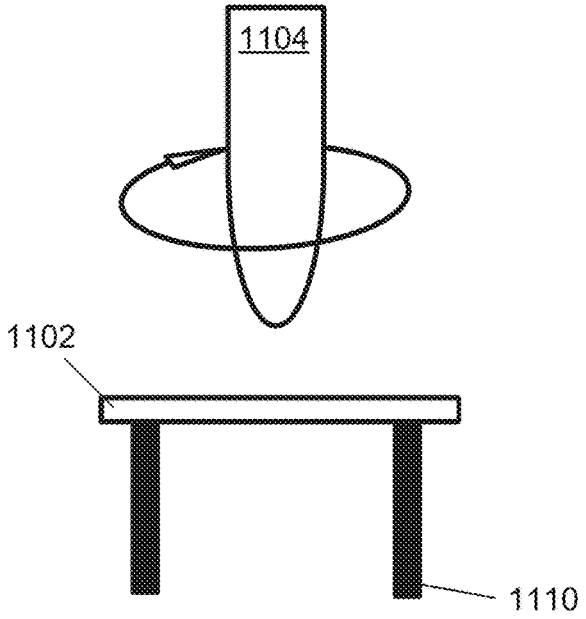
FIGS. 11A-11D illustrate frictionally heating a sheet of material including a metallic glass-based material so as to shape it in accordance with an embodiment of the invention.
Figure 11B:
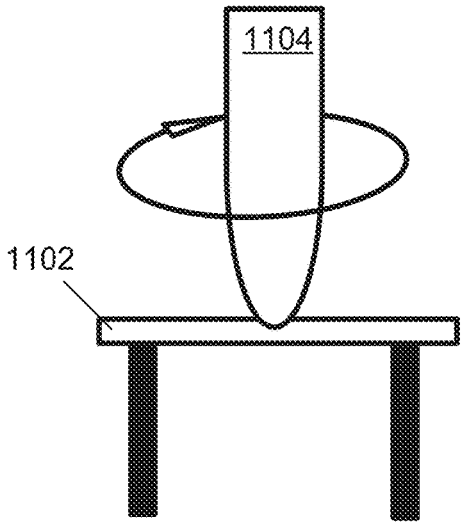
Figure 11C:
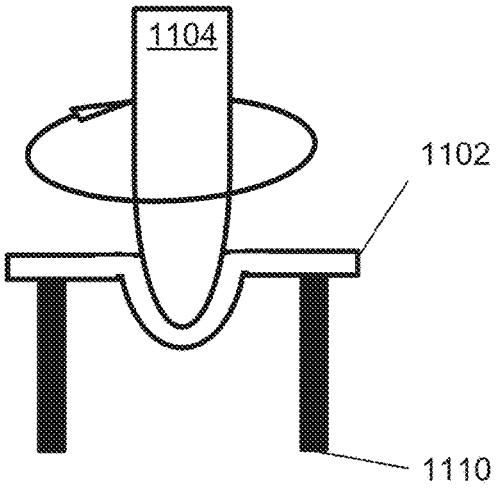
Figure 11D:
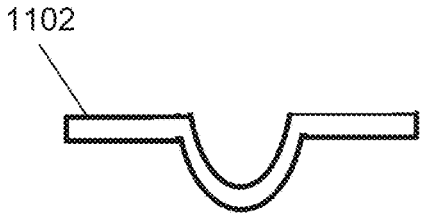

FIGS. 11A-11D depict shaping a sheet of material including a metallic glass-based material using frictional heating caused by a shaping tool that incorporates a parabola-shaped head in accordance with embodiments of the invention. In particular, FIG. 11A depicts the initial setup for the process that includes a sheet of material 1102 that itself includes a metallic glass-based material being supported by structures 1110. The shaping tool 1104 includes a parabola-shaped head, and is shown rotatable about its central axis, so that it can generate the requisite friction to elevate the temperature of the constituent metallic glass-based material above its glass transition temperature. FIG. 11B depicts the direct contact between the shaping tool 1104 and the sheet of material 1102 while the shaping tool 1104 is spinning, so as to generate frictional heating. FIG. 11C depicts that the shaping tool has further penetrated the sheet of material 1104 because of the thermoplastic shaping process; note that with greater penetration of the sheet of material, there is more surface area in direct contact between the shaping tool 1104 and the sheet of material 1102, and correspondingly more frictional heating. FIG. 11D depicts the resulting shape of the sheet of material 1102 after the processing. As can be inferred from the illustrations, frictional heating can be used to locally thermoplastically shape sheets of material, as the frictional heating can be relatively localized.

Figure 12A:
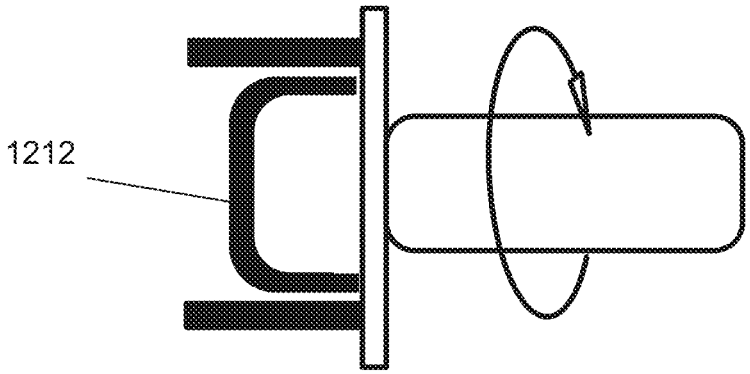
FIGS. 12A-12B illustrate frictionally heating a sheet of material including a metallic glass-based material so as to shape it and using a mold cavity to support the shaping process in accordance with an embodiment of the invention.
Figure 12B:
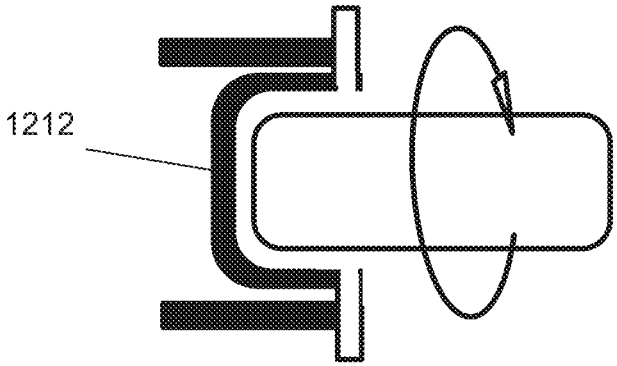

Although the above description and accompanying illustration depicts the using a shaping tool to shape the metallic glass sheet without the support of a mold cavity, in many embodiments a mold cavity is also used to help shape the sheet of material. FIGS. 12A-12B depict using a mold cavity in conjunction with a cylindrical shaping tool to help shape a sheet of material in accordance with embodiments of the invention. In particular, FIGS. 12A-10B are similar FIGS. 12A-12C, except they further depict a mold cavity 1212 that accommodates the deformation caused by the shaping tool.

Figure 13A:
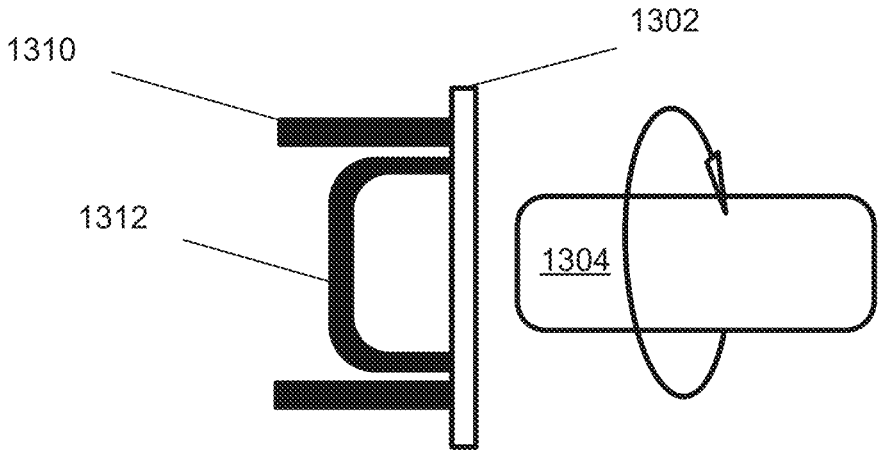
FIGS. 13A-13C illustrate frictionally heating a sheet of material including a metallic glass-based material, and using a separate mechanism to shape the heated sheet of material.
Figure 13B:
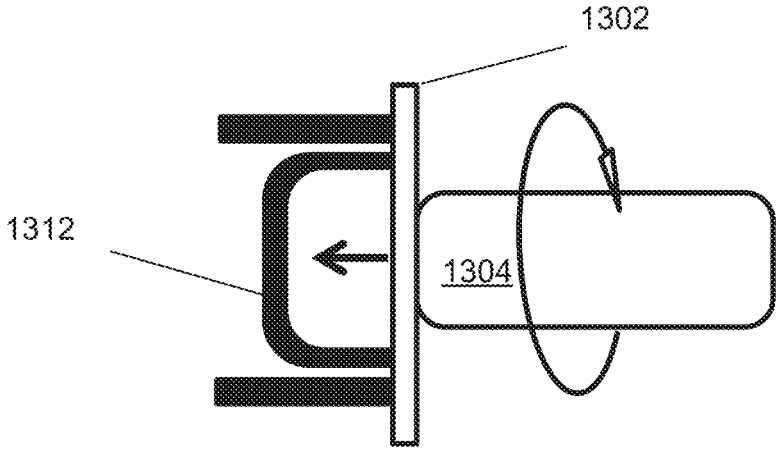
Figure 13C:
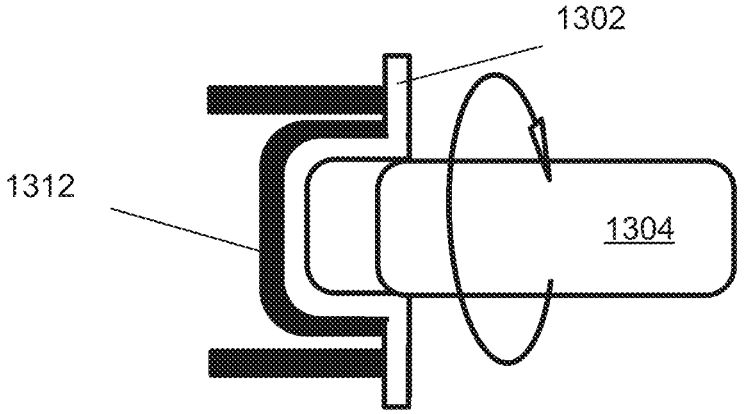

While the above descriptions have regarded scenarios where the shaping tool is also used to provide frictional heating, in many embodiments the friction causing mechanism and the shaping mechanism are distinct. For example, FIGS. 13A-13C depict that a pressure difference is used to thermoplastically shape a sheet of material after it has been frictionally heated. In particular, FIG. 13A depicts an initial setup that includes a sheet of material 1302 supported by a structure 1310, a friction causing surface 1304, as well as a mold cavity 1312. As before, the friction causing surface is rotatable about its central axis, and can thereby generate friction. FIG. 13B depicts that the friction causing surface 1304 frictionally heats the sheet of material 1302 to a temperature above the relevant glass transition temperature. FIG. 13C depicts that an imposed pressure difference between the region outside of the mold cavity 1312 and the mold cavity can cause the desired deformation. For example, the region outside the mold cavity can be filled with pressurized gas to cause the sheet material to conform to the mold cavity 1312. Although, a pressure differential is used to cause the desired shaping, it should be clear that any shaping technique can be used in conjunction with frictional heating in accordance with embodiments of the invention. For example, a distinct pressing mechanism can be implemented.

In general, similar to before, the above-described processing techniques can be modified in any of a variety of ways in accordance with embodiments of the invention. While the above processes have largely regarded the thermoplastic shaping of metallic glass-based sheet materials, in many embodiments, shaping processes for cold-forming sheet materials including metallic-glass based materials that include crystalline inclusions are implemented, and these are now discussed in greater detail below.

Figure 14:
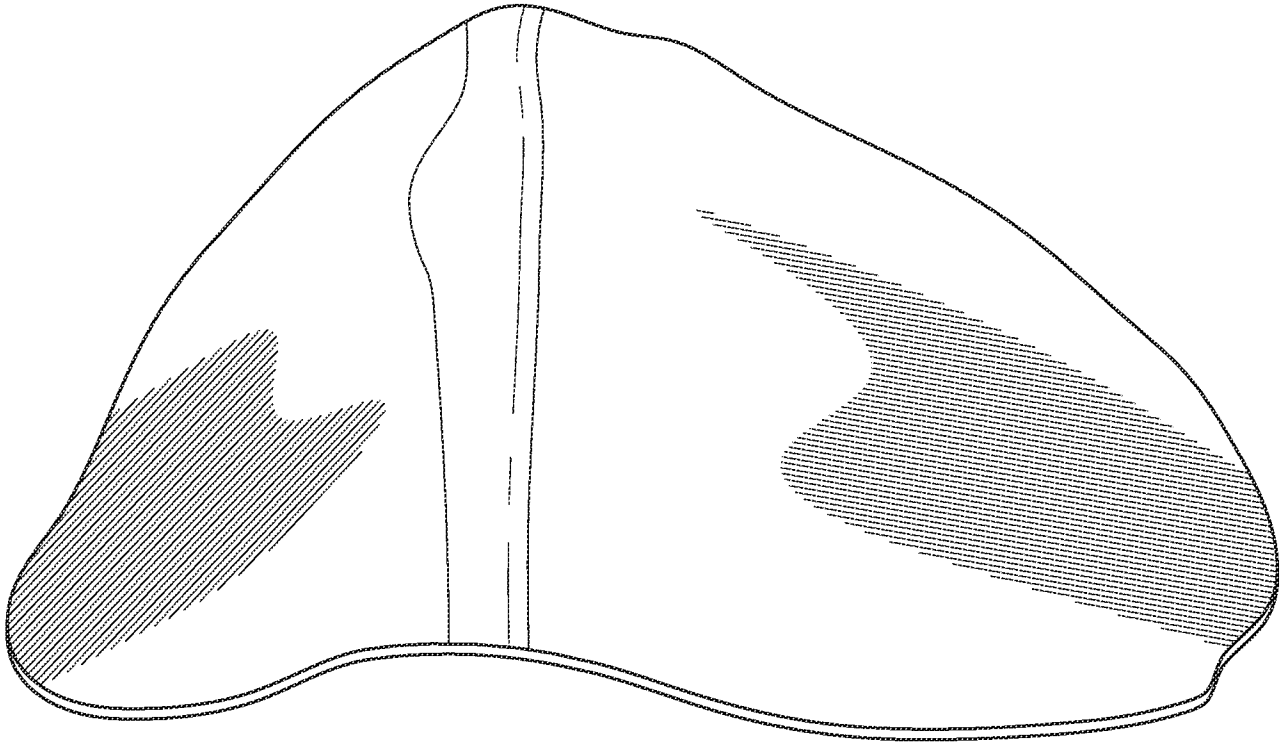
FIG. 14 depicts a DH1 metallic alloy that has be cold formed in accordance with an embodiment of the invention.

Cold-Forming of Sheet Materials Comprising Metallic-Glass Based Materials that Include Crystalline Inclusions Metallic glass-based materials are typically characterized as somewhat brittle (at least relative to conventional engineering metals such as steel), and their shaping largely revolves around thermoplastic deformation. However, in many embodiments of the invention, metallic glass-based materials that include crystalline inclusions undergo shaping procedures at temperatures below the respective glass transition temperature. In effect, the crystalline inclusions impart sufficient ductility to allow for such 'cold-forming.' In many embodiments, the constituent metallic glass-based material includes greater than approximately 30% crystalline inclusions (by volume) and has a fracture toughness of greater than approximately 80 $MPa \cdot m^{1/2}$. In a number of embodiments, the constituent metallic glass-based material includes greater than approximately 40% crystalline inclusions (by volume) and has a fracture toughness greater than approximately 100 $MPa \cdot m^{1/2}$. These characteristics can impart sufficient toughness to the sheet material to allow it to be cold formed. As an example, FIG. 14 depicts the cold-forming of a DH1 alloy ($Zr_{55.3}Ti_{24.9}Nb_{10.8}Cu_{6.2}Be_{2.8}$) in accordance with embodiments of the invention. Note that the material survived the bending without brittle failure. The depicted sheet had a thickness of 0.8 mm. In many embodiments, the thickness of the sheet material is less than approximately three times the size of the plastic zone radius of the constituent metallic glass-based material. In many embodiments, the thickness of the sheet material is less than approximately ⅓ the size of the plastic zone radius of the constituent metallic glass-based material. In essence, contrary to conventional wisdom, metallic glass-based materials can be made to withstand cold-forming operations.

Figure 15:
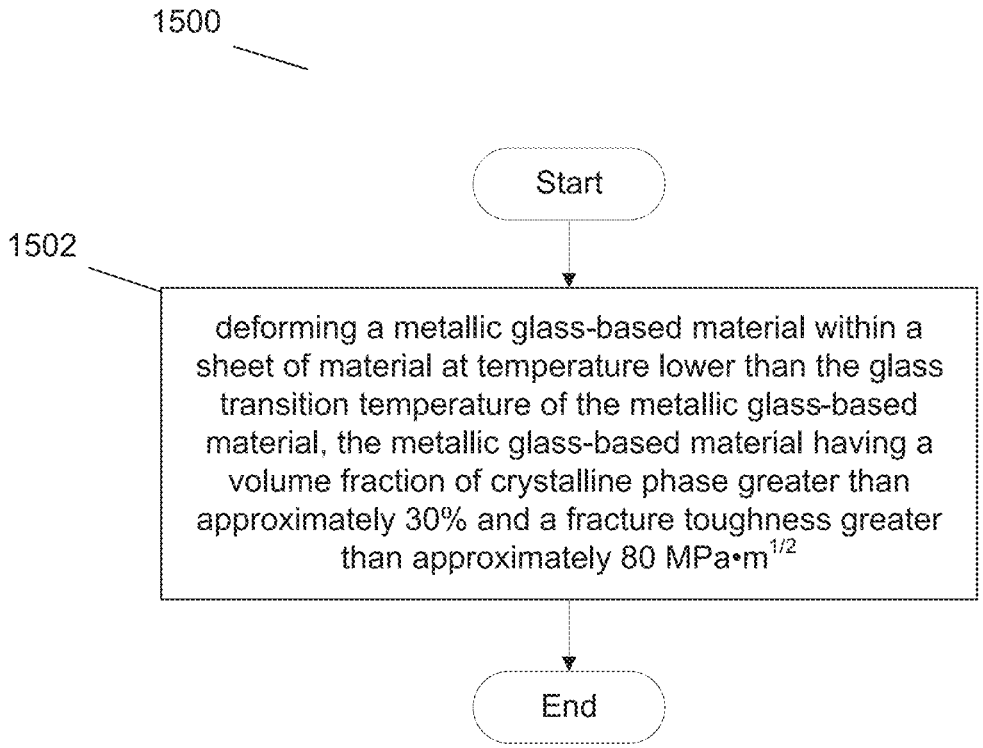
FIG. 15 illustrates a method of cold-forming a sheet material including a metallic glass-based material in accordance with an embodiment of the invention.

FIG. 15 depicts one method of cold-forming a sheet of material including a metallic glass-based material in accordance with embodiments. In particular, the method 1500 includes deforming 1502 a metallic glass-based material within a sheet of material at a temperature lower than the glass transition temperature of the metallic glass-based material, the metallic glass-based material having a volume fraction of crystalline phase greater than approximately 30% and a fracture toughness greater than approximately 80

Figure 16A:
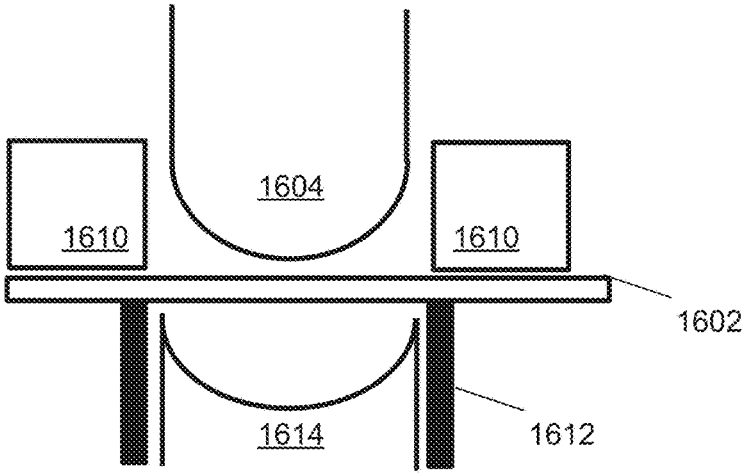
FIGS. 16A-16C depict pressing a sheet of material including a metallic glass-based material at a temperature less than the glass transition temperature of the metallic glass-based material in accordance with embodiments of the invention.
Figure 16B:
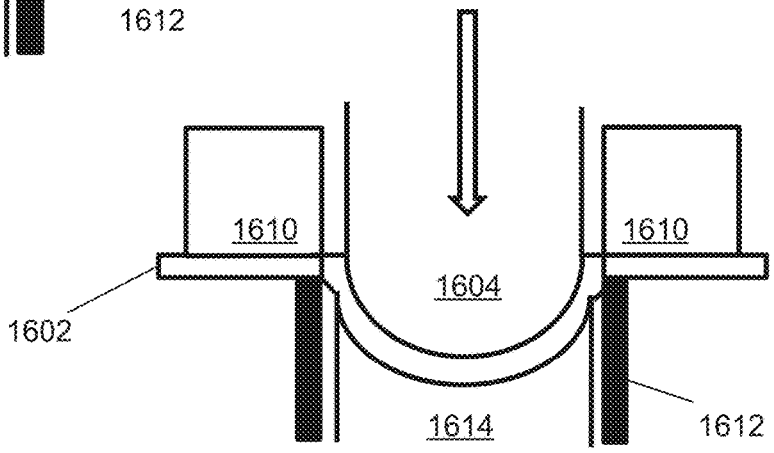
Figure 16C:
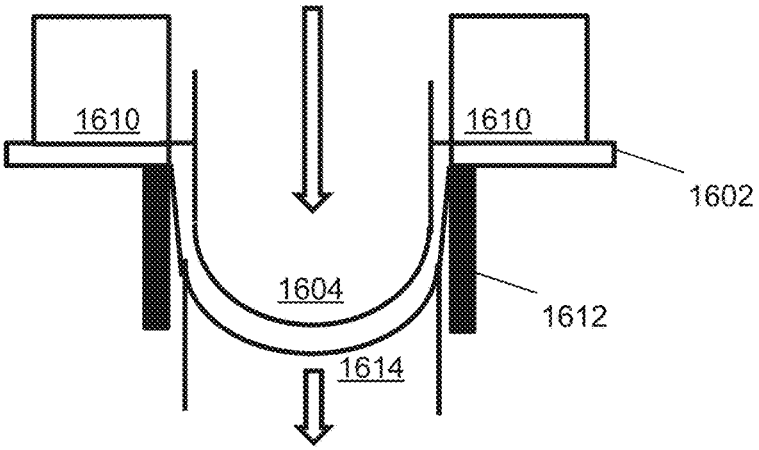

$MPa \cdot m^{1/2}$. As mentioned previously, these characteristics can impart sufficient toughness to the metallic glass-based material to allow it to survive cold-forming operations. Additionally, as can be appreciated, any suitable cold-forming operation can be implemented on metallic glass-based sheet materials having sufficient toughness. For example, FIGS. 16A-16C depict a pressing operation that can be implemented in accordance with embodiments of the invention. In particular, FIG. 16A depicts the initial setup that includes metallic glass-based sheet material that includes at least approximately 30% crystalline inclusions (by volume) 1602, a pressing tool, 1604, supporting structures 1610, 1612, and a mold cavity 1614. Importantly, the constituent metallic glass-based material has a fracture toughness of greater than approximately 80 $MPa \cdot m^{1/2}$. FIG. 13B depicts that the press 1602 is used to shape the sheet material 1602 at a temperature less than the glass transition temperature of the constituent metallic glass-based material. The material properties of the metallic glass-based sheet material (e.g. its toughness) allow it to survive the pressing operation. FIG. 16C depicts that the mold cavity 1614 can move with the press 1604 to relax excess pressure. As can be appreciated, FIGS. 16A-16C are akin to a deep drawing process.

It should of course be clear that any of a variety of forming operations can be implemented in accordance with embodiments of the invention. For example, in many embodiments, the sheet materials are formed using stamping tools. In a number of embodiments, they are formed with water jets. In several embodiments, lasers are used to shape the structures. In general, any of a variety of shaping procedures can be implemented.

Figure 17A:
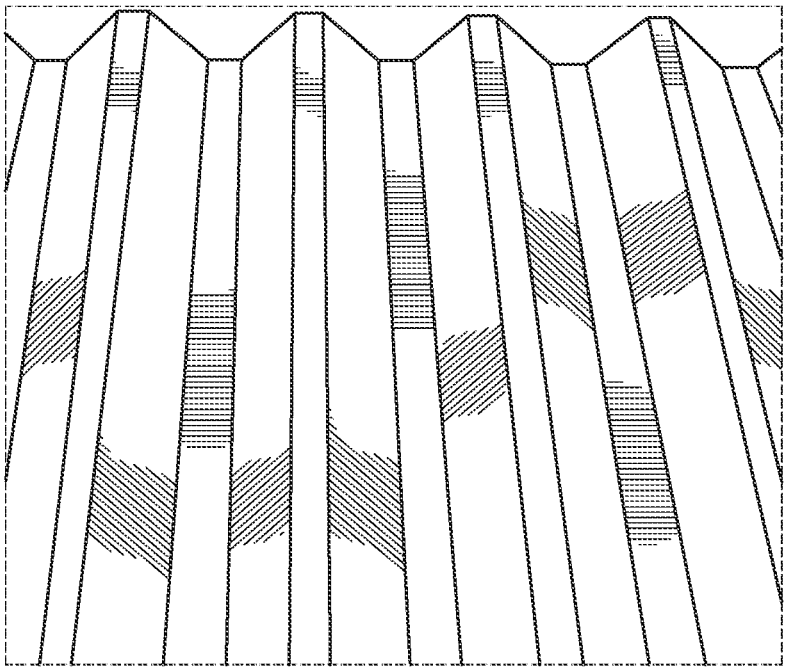
FIGS. 17A-17B depict cellular structures that can be created using cold-forming techniques in accordance with embodiments of the invention.
Figure 17B:
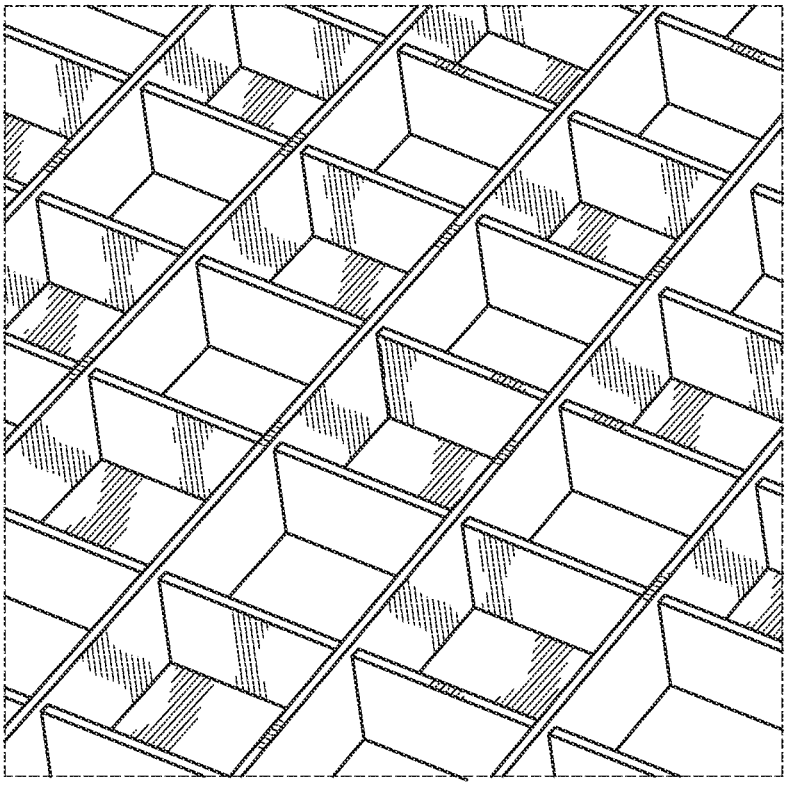

Notably, the above-described processes can be used to create any of a variety of geometries. For example, in many embodiments, cellular structures are created. FIGS. 17A-17B depict cellular geometries that may be created by cold-forming sufficiently tough sheet materials that include metallic glass-based materials in accordance with embodiments of the invention. Cellular structures are often desired for their energy absorbing capabilities. Indeed, whereas cellular structures are typically fabricated from conventional engineering materials, cellular structures fabricated from tough metallic glass-based materials can demonstrate enhanced energy absorbing traits.

Figure 18:
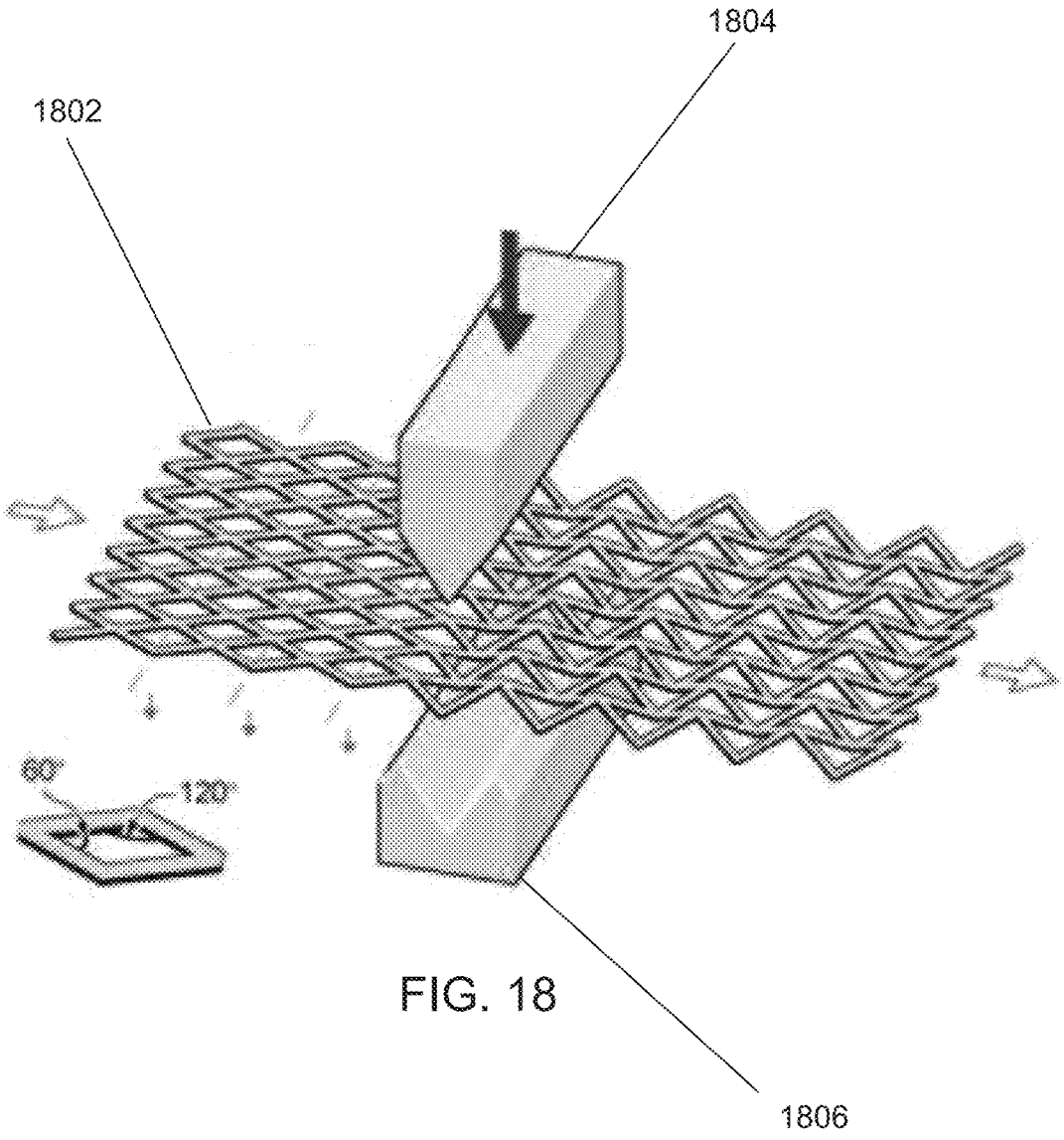
FIG. 18 illustrates cold-forming a sheet of material including a metallic glass-based material so as to form a cellular structure in accordance with an embodiment of the invention.

FIG. 18 depicts using a punch and die to form a 3D cellular structure in accordance with embodiments of the invention. In particular, it is illustrated that a sheet 1802 being constituted of a metallic glass-based material has been pre-formed so that it includes a series of diamond-shaped holes, thereby adopting a 'fence-like' shape. In other words, portions of the sheet material have been removed in a periodic fashion to form the fence-like shape. The portions can be removed using any suitable technique in accordance with embodiments of the invention. For instance, water jets can be used to carve out the diamond-shaped holes; alternatively, lasers can be used. As can be appreciated, the metallic glass-based material can be any such material having greater than approximately 30% crystalline inclusions (by volume) and a fracture toughness of greater than approximately 80 $MPa \cdot m^{1/2}$. A punch 1804 and die 1806 are used to add a vertical dimension to the sheet 1802 and thereby create a cellular structure. As can be appreciated, the toughness of the metallic glass-based material can allow it to withstand the cold-forming operation. Thus, it is seen that 3D cellular structures can be efficiently made in accordance with embodiments of the invention.

As can be inferred from the above discussion, the above-mentioned concepts can be implemented in a variety of arrangements in accordance with embodiments of the invention. Accordingly, although the present invention has been described in certain specific aspects, many additional modifications and variations would be apparent to those skilled in the art. It is therefore to be understood that the present invention may be practiced otherwise than specifically described. Thus, embodiments of the present invention should be considered in all respects as illustrative and not restrictive.

What is claimed is:

1. A method of shaping a sheet of a metallic glass-based material comprising:

heating a first region within a sheet of a metallic glass-based material, such that the heating is continuous through the entire thickness of the first region of the said sheet of metallic glass-based material, to a forming temperature greater than the glass transition temperature of the metallic glass-based material but less than the crystallization temperature of the metallic glass-based material;

wherein the sheet of material has a thickness of between approximately 0.1 mm and approximately 10 mm; and wherein at least some portion of the sheet of material that is continuous through the thickness of the sheet of material does not include metallic glass-based material that is heated above its respective glass transition temperature when the metallic glass-based material within the first region is heated to the forming temperature; and wherein heating the metallic glass-based material within the first region is accomplished using a localized heating method selected from induction heating and frictional heating; and deforming the metallic glass-based material within the first region across the entire thickness of the metallic glass-based material within the first region, while the temperature of the metallic glass-based material within the first region is at the forming temperature;

wherein deforming the metallic glass-based material within the first region is accomplished by pressing a shaping tool into the sheet of material.

2. The method of claim 1, wherein the sheet of material has a thickness of between approximately 0.1 mm and approximately 3 mm.

3. The method of claim 1, wherein at least a majority of the sheet of material, as measured by volume, does not include metallic glass-based material that is heated above its respective glass transition temperature when the metallic glass-based material within the first region is heated above its respective glass transition temperature.

4. The method of claim 1, wherein the sheet of material is between approximately 0.1 mm and 3 mm.

5. The method of claim 1, wherein the metallic glass-based material that is heated above its glass transition temperature is maintained at a temperature lower than its crystallization temperature.

6. The method of claim 1, wherein further comprising:

moving a surface relative to a sheet of material comprising a metallic glass-based material while the surface and the sheet of material are in direct contact so as to frictionally heat the metallic glass-based material within the sheet of material above its glass transition temperature;

wherein the sheet of material has a thickness of between approximately 0.1 mm and approximately 10 mm;

deforming the metallic glass-based material that has been heated by the frictional heating to a temperature above its glass transition temperature.

7. The method of claim 6, wherein the sheet of material has a thickness of between approximately 0.1 mm and approximately 3 mm.

8. The method of claim 7, wherein the metallic glass-based material that has been heated by the frictional heating is maintained at a temperature lower than its crystallization temperature during the frictional heating.

9. The method of claim 6, wherein moving the surface relative to the sheet of material comprises rotating the surface relative to the sheet of material so as to frictionally heat it.

10. The method of claim 1, wherein the tool is parabola shaped.

11. The method of claim 9, wherein deforming the metallic glass-based material is accomplished by pressing the surface into the sheet of material.

12. The method of claim 11, wherein deforming the metallic glass-based material is accomplished by pressing the surface into the sheet of material so that it conforms to the shape of a mold cavity.

13. The method of claim 9, wherein deforming the metallic glass-based material is accomplished by using pressurized gas.

14. The method of claim 1, wherein the heating is accomplished in a contactless manner.

15. The method of claim 1, wherein the heating comprises disposing an induction coil about the first region.

16. The method of claim 6, wherein the first region is confined to a planar volume directly corresponding to the dimension of the surface contacting the sheet of material and extending through the depth of the sheet of material.

17. The method of claim 15, wherein the first region is confined to a planar volume directly corresponding to the dimension of the induction coil and extending through the depth of the sheet of material.

* * * * *